US008578543B2

(12) United States Patent
Policicchio et al.

(10) Patent No.: US 8,578,543 B2
(45) Date of Patent: Nov. 12, 2013

(54) SQUEEGEE HAVING AT LEAST ONE RENEWABLE BLADE SURFACE FOR TREATING A TARGET SURFACE

(75) Inventors: Nicola John Policicchio, Mason, OH (US); William Michael Cannon, West Harrison, IN (US); Patricia R. Soll, Liberty Township, OH (US); Kuang-Kai Liu, Cincinnati, OH (US); Mark John Steinhardt, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 202 days.

(21) Appl. No.: 13/091,333

(22) Filed: Apr. 21, 2011

(65) Prior Publication Data

US 2012/0266916 A1 Oct. 25, 2012

(51) Int. Cl.
*A47L 1/06* (2006.01)
*A47L 1/08* (2006.01)

(52) U.S. Cl.
USPC ..... 15/104.94; 15/121; 15/232; 15/220.1; 15/245

(58) Field of Classification Search
USPC ..... 15/104.94, 121, 231, 232, 220.1, 245
See application file for complete search history.

(56) References Cited

U.S. PATENT DOCUMENTS 995,785 A * 6/1911 Grimson ..... 15/105
1,179,918 A 4/1916 Hayden
1,459,071 A 6/1923 Mumaw
2,265,266 A 12/1941 Cote
2,394,585 A 2/1946 Bailey
2,842,789 A 7/1958 Wells
3,613,146 A * 10/1971 Oviatt ..... 15/231
3,656,202 A 4/1972 Paton
3,721,502 A 3/1973 Ognibene
4,106,153 A 8/1978 Lemelson
4,121,315 A 10/1978 Buser
4,312,093 A 1/1982 Raab
4,391,014 A 7/1983 Pitzen
4,398,839 A 8/1983 Kluck
4,575,890 A 3/1986 Hidle
4,601,938 A 7/1986 Deacon et al.
4,910,825 A 3/1990 Mauer (Continued)

FOREIGN PATENT DOCUMENTS

EP 941689 * 9/1999
FR 2899456 * 10/2007
JP 9-262193 * 10/1997
JP 2000-229055 A 5/2000

OTHER PUBLICATIONS

U.S. Appl. No. 13/091,297, filed Apr. 21, 2011, Steinhardt, et al.

(Continued)

*Primary Examiner* — Mark Spisich
(74) *Attorney, Agent, or Firm* — Larry L. Huston; Steven W. Miller

(57) ABSTRACT

A device for treating a target surface, such as occurs when cleaning a window. The device has plural squeegee blades joined by a head. The head has a slot therethrough. A sheet may be longitudinally move over one or more than one of the blades to renew its surface before, during or after use. Each squeegee blade may have a dedicated sheet. The sheet(s) may travel through the slot to originate from or be stored within the head.

20 Claims, 20 Drawing Sheets

(56) References Cited

U.S. PATENT DOCUMENTS

| | | | | |
|---|---|---|---|---|
| 5,092,699 | A * | 3/1992 | Silvenis | 401/21 |
| 5,337,523 | A | 8/1994 | Walsh | |
| 5,359,818 | A | 11/1994 | Costa | |
| 5,469,594 | A | 11/1995 | Nolte | |
| 5,497,530 | A | 3/1996 | Kamm et al. | |
| 5,592,043 | A | 1/1997 | Gartner et al. | |
| 5,615,449 | A | 4/1997 | Sepke | |
| 5,681,387 | A | 10/1997 | Schmidt | |
| 5,756,112 | A | 5/1998 | Mackey | |
| 5,920,942 | A | 7/1999 | Footer | |
| 5,948,540 | A | 9/1999 | Mackey et al. | |
| 5,970,560 | A | 10/1999 | Leroux | |
| 5,980,922 | A | 11/1999 | Mackey et al. | |
| 6,001,381 | A | 12/1999 | Gordon et al. | |
| 6,065,890 | A | 5/2000 | Weitz | |
| 6,092,255 | A | 7/2000 | Kim | |
| 6,133,166 | A | 10/2000 | Nissing | |
| 6,245,413 | B1 | 6/2001 | Kenmochi et al. | |
| 6,343,397 | B1 | 2/2002 | Odagiri | |
| 6,668,418 | B2 | 12/2003 | Bastien | |
| 6,683,041 | B1 | 1/2004 | Nissing et al. | |
| 6,702,497 | B1 | 3/2004 | Tien | |
| 6,865,767 | B1 | 3/2005 | Gavney, et al. | |
| 6,872,021 | B1 | 3/2005 | Wilson et al. | |
| 7,350,257 | B2 * | 4/2008 | McKay | 15/118 |
| 7,363,765 | B2 | 4/2008 | Szszesuil et al. | |
| 7,386,907 | B2 | 6/2008 | Otsuka et al. | |
| 7,574,767 | B2 | 8/2009 | Michaels et al. | |
| 7,594,294 | B2 | 9/2009 | Billig et al. | |
| 7,837,801 | B2 * | 11/2010 | Christopher et al. | 134/6 |
| D629,835 | S | 12/2010 | Rayborn | |
| 2004/0111817 | A1 | 6/2004 | Chen et al. | |
| 2007/0130713 | A1 | 6/2007 | Chen et al. | |
| 2007/0220693 | A1 | 9/2007 | Billig | |

OTHER PUBLICATIONS

U.S. Appl. No. 13/091,310, filed Apr. 21, 2011, Steinhardt, et al.
U.S. Appl. No. 13/091,320, filed Apr. 21, 2011, Steinhardt, et al.

* cited by examiner

SQUEEGEE HAVING AT LEAST ONE RENEWABLE BLADE SURFACE FOR TREATING A TARGET SURFACE

FIELD OF THE INVENTION

The present invention relates to devices usable to treat a target surface. The treatment may include applying liquid to and/or removing liquid from the target surface.

BACKGROUND OF THE INVENTION

Devices for treating target surfaces are well known in the art. Such devices include squeegees, concrete floats, dust mops having renewable surfaces, dust mops having replaceable surfaces, such as the Swiffer Sweeper sold by the instant assignee.

These devices typically have a blade or other edge which contacts the target surface. The blade may be used to spread a liquid for treating the target surface or for removing liquid from the target surface. For example, a squeegee blade may be used to remove cleaning solution, and concomitantly remove soil, from a window.

When a squeegee is used for this purpose, the user often wipes the blade clean between passes on the window. The wiping has several disadvantages. First, the blade must be removed from the surface, leaving a line at each edge of the blade. The lines disrupt the clean appearance of the window. The blade must be wiped with a cloth or paper towel, which in turn must be cleaned and or discarded. Neither step is as environmentally friendly as many would desire. Further, wiping at each pass takes time, lengthening the entire cleaning process.

By way of another example, the blade may be used to spread stain or lacquer on a hardwood floor. As the stain or lacquer begins to cure, it may become viscous and stick to the blade. When cured material sticks to the blade, it presents an uneven surface which is not suitable for evenly spreading additional stain or lacquer.

The user may attempt to compensate for the material sticking to the blade by wiping the blade clean. Again, this wiping step presents substantially the same disadvantages discussed above with respect to window cleaning.

An early attempt in the art is shown in U.S. Pat. No. 629,835 which shows a window cleaner having two cloth arches for holding a liquid to be applied to a window and a rubber strip for removing moisture from the window. Another early attempt is shown in U.S. Pat. No. 2,842,789 which shows a window cleaner having a combined sponge and squeegee. And U.S. Pat. No. 2,265,266 shows a squeegee having a plurality of wiping edges. Yet another attempt is shown in U.S. Pat. No. 1,459,071 which shows a window cleaner having a water distribution pipe and a rubber squeegee. Similar attempts are shown in U.S. Pat. Nos. 5,615,449 and 6,065,890. U.S. Pat. No. 5,497,530 shows a wiper having a pad and suction nozzle.

Yet another attempt is shown in U.S. Pat. No. 4,312,093 which teaches a device having a wiper blade and moistening member. U.S. Pat. No. 3,721,502 teaches an apparatus having a combined roller and squeegee. U.S. Pat. No. 4,398,839 teaches a squeegee blade for use on an irregular surface, while U.S. Pat. No. 5,681,387 teaches a segmented squeegee blade. U.S. Pat. No. 4,910,825 teaches an attachment for a squeegee having a resilient mounting member.

One attempt in the art to overcome the problem of contamination on the blade of a window cleaning squeegee is found in U.S. Pat. No. 6,668,418 which teaches a tool intended to wipe cleaning liquid from the window. The tool has an absorbing means and a guide to provide capillary action between absorbing means and a blade. U.S. Pat. No. 7,594,294 teaches an implement for cleaning a window and having an inset area to collect pooled liquid cleaner before that cleaner is re-absorbed into a substrate. U.S. Pat. No. 6,702,497 teaches a cleaning device having an area for distribution and temporary storage of cleaning fluid. But these attempts do not overcome the problem of dirty cleaning solution, having soluble soils therein, being re-deposited on the very surface intended to be cleaned.

Disposable cleansing articles may be provided with an emulsion which releases an internal phase liquid during use. Examples are shown in commonly assigned U.S. Pat. No. 5,756,112; U.S. Pat. No. 5,948,540; U.S. Pat. No. 5,952,043; U.S. Pat. No. 5,980,922; U.S. Pat. No. 6,001,381; U.S. Pat. No. 6,133,166 and U.S. Pat. No. 6,683,041.

U.S. Pat. No. 5,469,594 teaches a cleaning tool having a scraping element and a liquid absorbing element which can either moisten an object to be cleaned or remove moisture therefrom. U.S. Pat. No. 1,179,918 teaches a wiping implement having plural masses of cleaning material. US 2007/0220693 teaches a cleaning implement having a support head with three sides, including an applicator side and two absorbent sheet sides. Other attempts are found in U.S. Pat. No. 5,970,560 and U.S. Pat. No. 6,872,021. U.S. Pat. No. 6,092,255 teaches a combination scraper, squeegee and sponge having a curved edge. U.S. Pat. No. 3,656,202 teaches a combined sponge, scouring material and squeegee in an implement.

U.S. Pat. No. 6,865,767 teaches a device having a resilient contact element with different primary and secondary contact structures. U.S. Pat. No. 7,574,767 teaches a cleaning implement having a squeegee blade sandwiched by absorbents on two sides, allowing for movement in first and second directions. U.S. Pat. No. 5,920,942 teaches a floor mop having a sponge with a wiper spaced therefrom a predetermined distance. U.S. Pat. No. 7,363,765 teaches a squeegee cleaning device intended to provide plural squeegee action directions.

But none of these attempts in the art satisfactorily overcome the problem of contamination of the target surface with dirty liquid. Further, none of these attempts in the art overcome the problem of renewal of the liquid upon demand, with a single device that does not rely upon a sprayer or recycled liquid. Accordingly, the search for better devices continues.

SUMMARY OF THE INVENTION

The invention comprises a device for treating a target surface. The device has a pressure applying member. A sheet is transported over the pressure applying member after use. The sheet renews the surface of the pressure applying member, so that a clean surface of the device can be presented to the target surface, as desired. The sheet may comprise a pre-wetted substrate for applying liquid to the target surface or may comprise a dry sheet for removing liquid from the target surface.

DETAILED DESCRIPTION OF THE INVENTION

Figure 1:
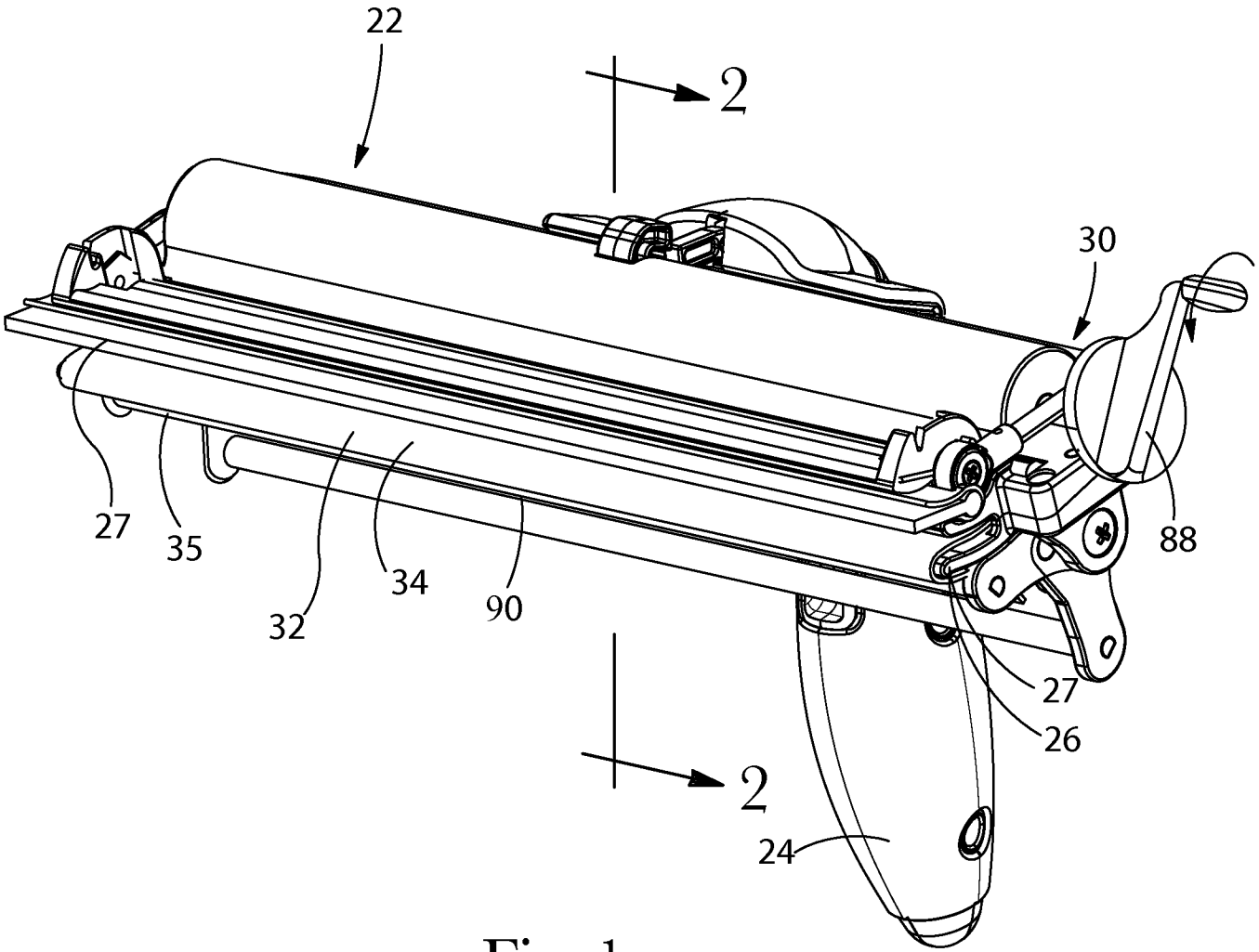
FIG. 1 is a frontal perspective view of a device according to the present invention having an optional rotatable crank, and a prewetted substrate which moves across a first pressure applying member and a squeegee blade which does not have a separate sheet.
Figure 2:
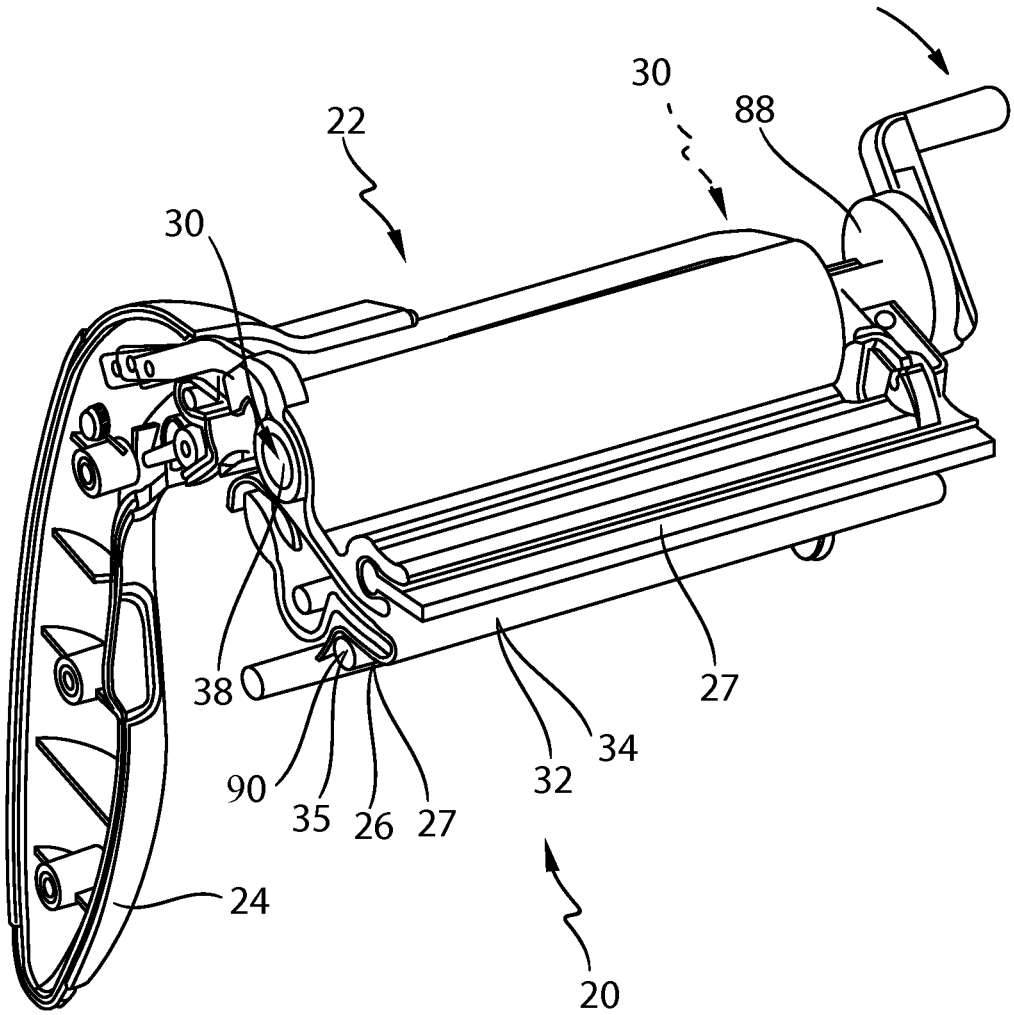
FIG. 2 is a perspective sectional view of the device of FIG. 1, taken along lines 2-2 of FIG. 1.

Referring to FIGS. 1 and 2, the invention may comprise a device 20 for treating a liquid while the liquid is on a target surface. Of course, one of skill will recognize that treating the liquid on the target surface may result in concomitant treatment of the target surface itself. The device 20 may comprise a head 22 and a handle 24 joined thereto. The head 22 may have a pressure applying member 26, such as a blade 27, to apply pressure to, and thereby treat, the target surface.

The head 22 may comprise a housing which may serve as a frame for the components contained therein. The head 22 may have a blade 27 juxtaposed therewith and extending in the widthwise direction. The widthwise direction extends laterally left to right as the head 22 is held in a horizontal position. The blade 27 extends from a proximal end juxtaposed with and supported by the housing to an opposed distal end. The distal end of the blade 27 contacts the target surface in the absence of an intervening component, such as a sheet as discussed hereinbelow. The blade 27 may be of constant thickness (taken perpendicular to the widthwise direction), may be tapered as the distal end is approached, or may be tapered throughout.

The device 20 may further have an optional sheet advance mechanism 30 to provide for movement of the sheet 32 across the distal end of a pressure applying member 26. The sheet advance mechanism 30 may be substantially contained in the head 22 of the device 20. The head 22 may also contain a supply of material and may also accommodate accumulation of material after it has been used and moved across the blade 27. The material may comprise a sheet 32. The sheet 32 may be dry, and as such will hereinafter be referred to as a sheet 32. Alternatively, the sheet 32 may be wet as presented to the user and as such will hereinafter be referred to as a prewetted substrate 34. It is to be understood the term sheet 32, without a dry or prewetted descriptor is inclusive of both dry sheets 32 and prewetted substrates 34.

Upon usage and advance past the distal end of the blade 27, the spent sheet 32 may be collected for cleaning and reuse, for recycling or for discarding. Alternatively, the supply of sheet 32 may be kept outboard of the head 22.

The blade 27 may be covered with a replaceable surface, allowing renewal of the blade 27 after a given usage. A given usage may be a single pass on a window to be cleaned, an entire window, tabletop, countertop, etc. which is cleaned, or multiple uses during a single cleaning task.

The replaceable surface provides the benefit that the risk of contamination from dirt or solution re-transferring to a freshly cleaned surface is minimized. Out-board lines of dirty solution either do not occur, or are greatly minimized.

The replaceable surface may be flexible so that it can travel from a first side of the blade 27, across the distal end and to the second, opposed side of the blade 27. The replaceable surface may be a sheet 32, such as a film, and particularly a non-absorbent film. The film may have sufficient strength to travel in the longitudinal direction, i.e. perpendicular to the width direction. The film may also have sufficient abrasion resistance to last though one or more usages.

One suitable replaceable surface, which provides renewal for the blade 27, is a polymeric film, and particularly a polyolefinic film, such as LDPE. The film may have a MD tensile strength of at least 8, 10, 12 or 15 N, a thickness of 0.03 to 1.0 millimeters, particularly 0.05 mm and a basis weight of 20 to 80, 30 to 70 or 50 gsm. One polyolefinic film which has been found suitable has a CD elongation of 760%, MD elongation of 620%, a thickness of 0.05 millimeters, a dry COF to metal of 0.3 to 0.4 and is available from Clopay Corp., of Mason, Ohio under model number M18-2562.

A magazine of film having a length in the longitudinal direction of 10 to 3000 cm, and particularly a 1800 cm has been found suitable. The film may have a widthwise dimension ranging from 5 to 60 cm and particularly about 25 cm.

Optionally the head 22 may float, i.e. move, relative to the handle 24. The head 22 may articulate relative to the handle 24 through a pivot. The axis of the pivot may be parallel to the width direction or skewed relative thereto.

The head 22 may comprise a renewable blade 27, or other renewable pressure applying member 26, for treating the liquid on the target surface. By renewable it is meant that a clean and dry first pressure applying member 26 is presented to the target surface upon renewal. The handle 24 may comprise a trigger 28 for actuating the sheet advance mechanism 30 which renews the pressure applying member 26 by advancing the sheet 32 across the distal end of the blade 27.

Prophetically, the pressure applying member 26 may be slightly convex, to increase local pressure or to conform to a convex target surface. Alternatively or additionally, the pressure applying member may be serrated, to provide troweling functionality, if a highly viscous liquid is being used on the target surface.

As noted above, the device 20 may further have an optional sheet advance mechanism 30 for advancing a sheet 32 through the head 22 and across the distal end of the blade 27. The sheet advance mechanism 30 may comprise any manually operable or powered mechanism for moving the sheet 32 across the distal edge of the blade 27.

The sheet 32 may unidirectionally longitudinally advance across the blade 27, although bidirectional motion is contemplated. The user may rotate the crank 88 in the direction of the arrow, to longitudinally move the sheet 32 across the blade 27 in an upwards direction. Alternatively, the user may load the sheet 32 above the pressure applying member 26, rotate the crank 88 in the opposite direction and longitudinally advance the sheet 32 across the blade 27 in a downward direction. Spent sheet 32 may be accumulated in a dedicated container (not shown) or may be left in the open, as shown. The sheet 32 may be dry, or may comprise a prewetted substrate 34.

With continuing reference to FIGS. 1-2, a sheet advance mechanism 30 may comprise a manually rotatable crank 88 connected to a nip roll 38. When the user wishes to renew the surface presented by the blade 27 to a window, or other target service, the user simply rotates the crank 88 until a desired amount of the sheet 32 has been advanced to or past the distal end of the blade 27. Rotation of the crank 88 results in like rotation of the nip roll 38. Rotation of the nip roll 38 frictionally engages the sheet 32, resulting in longitudinal advance of the sheet 32.

If desired, the device 20 may comprise a tucker bar 90. The tucker bar 90 may be articulable between an open position and a closed position. In the open position, the tucker bar 90 may provide for loading of the sheet 32 into the device 20. In the closed position, the tucker bar 90 may function as a tensioner, hold the sheet 32 taut, so that it does not slip when contacting the target surface.

When the tucker bar 90 is in the open position, the nip rolls 38 may be slightly separated to allow feeding of the sheet 32 therethrough. When the tucker bar 90 is articulated to the closed position, the nip rolls 38 may close, to provide for frictional rotation against the sheet 32.

This arrangement provides the benefit of simple construction and intuitive use. Furthermore, the user can advance various amounts/lengths of the sheet 32 as desired for different tasks, film materials, different blade 27 thicknesses, etc. If desired, the crank 88 may have a detente mechanism, as is known in the art.

Figure 3:
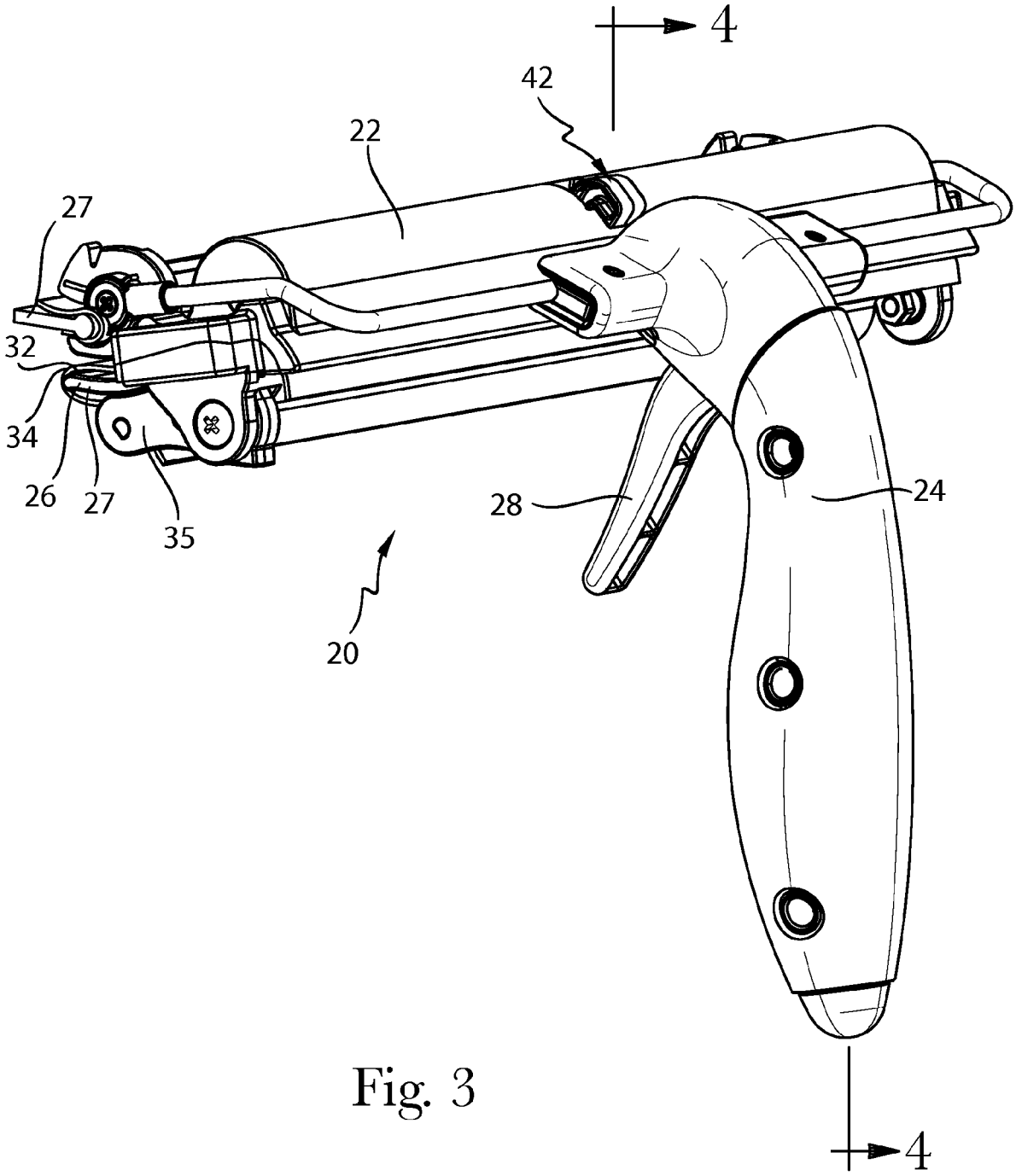
FIG. 3 is a rear perspective view of an alternative embodiment device, having a trigger usable as an advancing and indexing mechanism.
Figure 4:
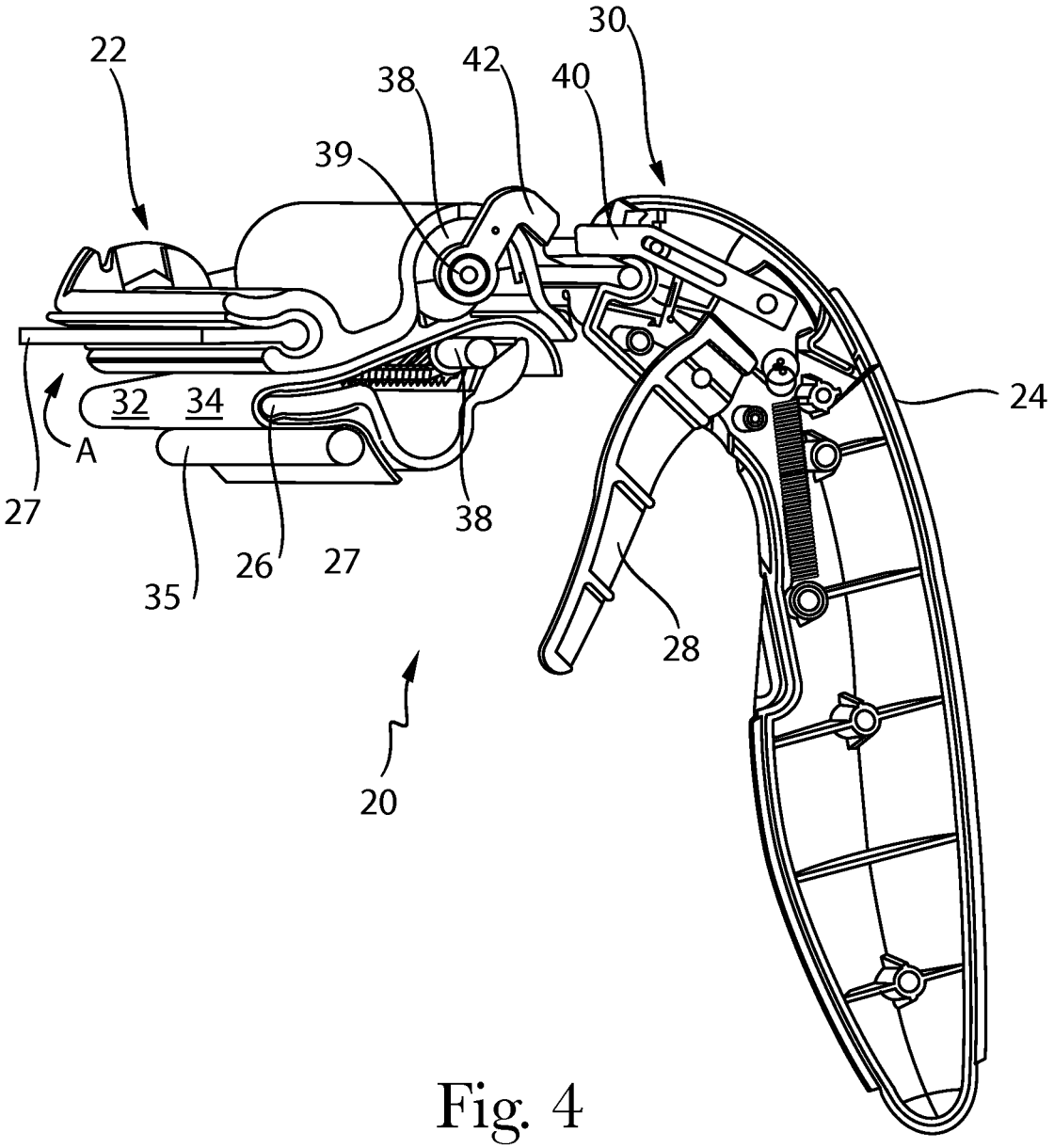
FIG. 4 is a perspective sectional view taken along lines 4-4 of FIG. 3 and having the trigger extended.
Figure 5:
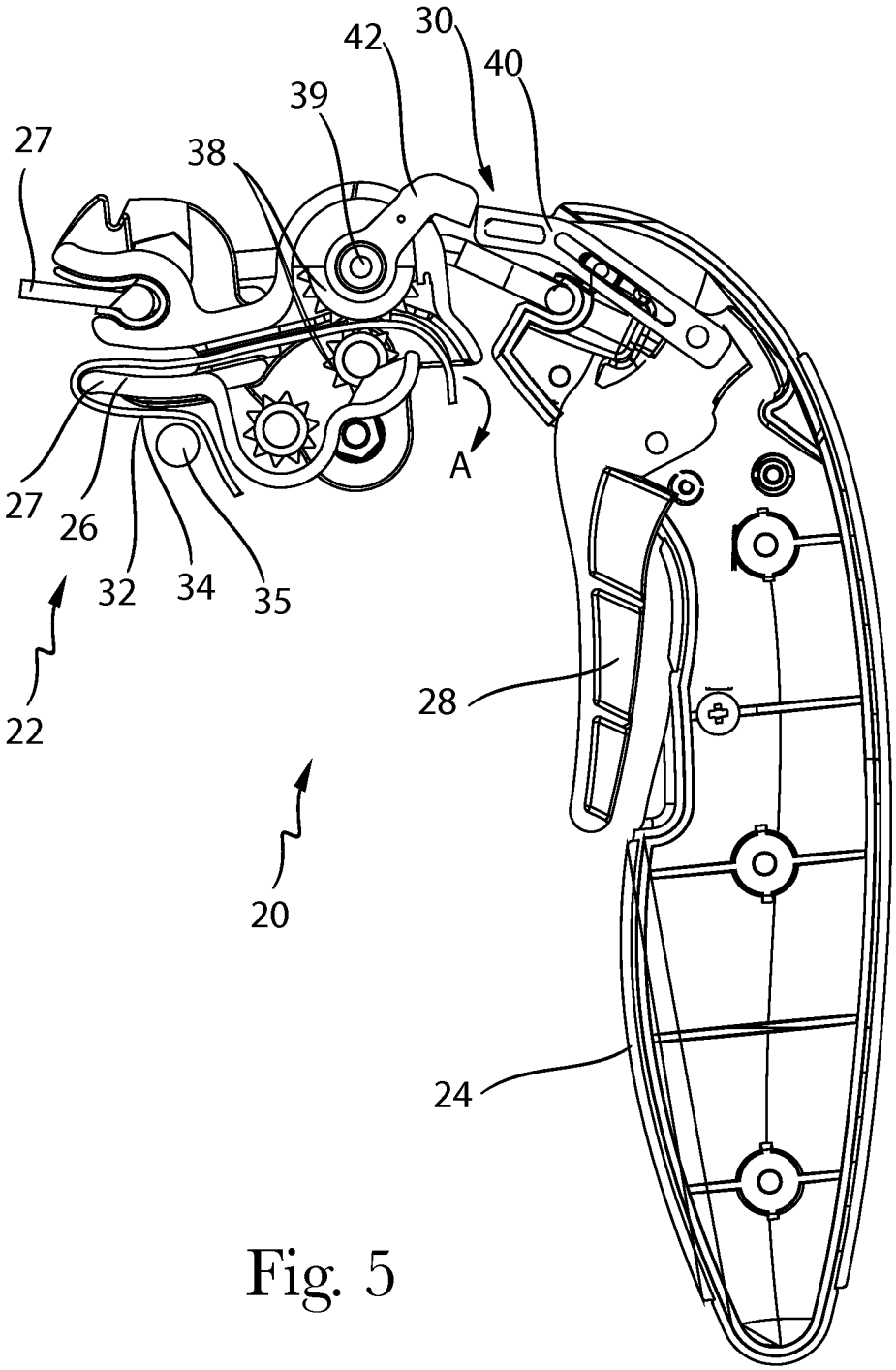
FIG. 5 is a profile sectional view of the device of FIG. 4 having the trigger retracted.
Figure 6:
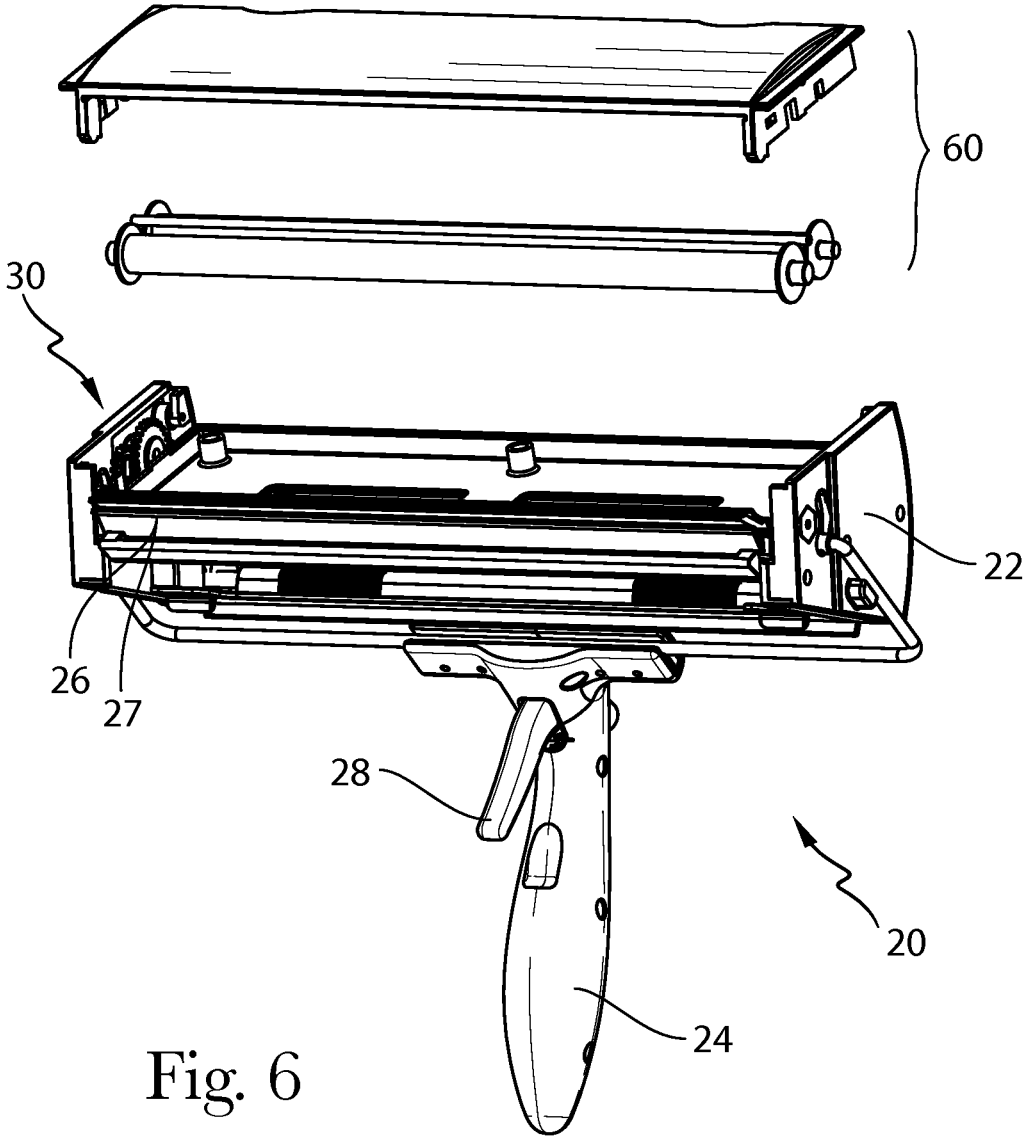
FIG. 6 is an exploded frontal perspective view of an alternative embodiment device and further comprising a cartridge removably insertable into the head to provide sheet material.

Referring to FIGS. 3, 4 and 5, if desired, the sheet advance mechanism 30 may index the sheet 32 a predetermined amount/length in the longitudinal direction with each advance. A suitable sheet advance mechanism 30 may be an indexing mechanism operated by the handle 24.

The sheet advance mechanism 30 may comprise one or more rolls 38 disposed in the head 22. The rolls 38 may be axially parallel, define a nip therebetween, and operate as nip rolls 38 to advance the sheet 32 therebetween and through the nip. Either or both rolls 38 may be driven to provide the draw through the nip, longitudinally advancing the sheet 32 in the direction of Arrow A.

One of the nip rolls 38 may have a one-way bearing 39 disposed circumjacent thereto. The one-way bearing 39 may be shrink fitted to, press fitted to or adhesively joined to the nip roll 38. An RC2 one-way bearing 39 available from The Timken Company of Canton, Ohio has been found suitable for this purpose.

The nip rolls 38, and take up roll, discussed below, provide the benefit of tensioning the sheet 32 against the blade 27 or other pressure applying member 26. By tensioning the sheet 32 against the pressure applying member 26, a more uniform sheet 32 is presented to the target surface, and the likelihood of tearing or inconsistent treatment of liquid on the target surface is reduced.

The sheet advance mechanism 30 may be activated by a trigger 28. The trigger 28 may be pivotably mounted to the handle 24, as shown or mounted to the head 22. Manual retraction of the trigger 28 may cause like forward motion of a lever 40 disposed on the other side of the pivot. Upon such forward motion, the lever 40 may intercept a pawl 42 joined to the one-way bearing 39. Intercepting the pawl 42, results in rotation of the pawl 42, the one-way bearing 39 joined thereto and ultimately the draw roll 38.

A return spring may be provided to rotatably bring the pawl 42 back to the starting position. Likewise a return spring may be utilized to return the trigger 28 to the starting position.

The nip roll 38 having the pawl 42 may be individually rotated by the action of the trigger 28. If desired, nip rolls 38 may comprise a drive roll 38 and a driven roll 38. The driven roll 38 is driven by the friction of the sheet 32 passing through the nip formed between the drive roll 38 and the driven roll 38. Alternatively, the rolls 38 may be geared together, so that both rolls 38 are driven by the action of the trigger 28/lever 40/pawl 42. This arrangement provides a nip with two driven rolls 38.

Optionally, the head 22 may further comprise an articulable holding bar 35. The optional holding bar 35 may be pivoted to an open position for insertion and/or removal of the sheet 32. The optional holding bar 35 may be pivoted to a closed position for retaining the sheet 32 in a compact position during use.

The holding bar 35 may further provide the benefit that, during use, the sheet 32 is held taut. A taut sheet 32 can be readily drawn across the distal end of the blade 27 or other pressure applying member 26 in an appropriate position.

Referring to FIGS. 6, 7, 8, 9 and 10, in an alternative device 20 the sheet 32 and/or the prewetted substrate 34 may be disposed in a cartridge 60. The cartridge 60 may be removably installed into the device 20, and particularly into the head 22 thereof.

Such an alternative device 20 may have a sheet advance mechanism 30 comprising a supply roll 50 and take-up roll 52, providing for travel of the sheet 32 therebetween. The supply roll 50 and take-up roll 52 may be geared together by a gear train to be mutually counter-rotating or may rotate in the same direction. The gear train may directly gear the take-up roll 52 to the supply roll 50 without an intermediate gear therebetween, or intermediate gears may be provided to achieve the desired gear ratio.

The supply roll 50 and take-up roll 52 may each have a diameter of 5 to 75 mm, and particularly about 10 mm, independent of any sheet 32 wound thereon. The supply roll 50 and take-up roll 52 may have a widthwise length ranging from 5 to 60 cm, and particularly about 25 cm. The corresponding blade 27 may have a widthwise dimension ranging from 5 to 60 cm and particularly about 23 cm.

Both the supply roll 50 and take-up roll 52 may be axially rotatable and/or may be parallel to the widthwise direction. The sheet 32 may be fed from the supply roll 50 to a first side of the blade 27, across the distal end of the blade 27 to the second side of the blade 27, and then accumulated on the take-up roll 52. The take-up roll 52 and optionally the supply roll 50 may be operated by an sheet advance mechanism 30. The sheet advance mechanism 30 may comprise a drive gear 54. The drive gear 54 may be directly coupled to both the supply roll 50 and take-up roll 52.

The sheet advance mechanism 30 may be operated by a cable 56. The cable 56 may be contained within a sheath, similar to a bicycle cable 56. One end of the cable 56 may be joined to a trigger 28. The trigger 28 articulates about a pivot axis, as discussed above. The other end of the cable 56 may be joined to a drive connected to the take-up roll 52 at a position longitudinally outboard of the sheet 32.

The cable 56 may have a length ranging from 30 to 50 centimeters, or 35 to 45 centimeters, and may particularly be about 40 centimeters long for convenient operation. Such a cable 56 may be attached to the trigger 28 at a radial distance of 20 centimeters from the pivot axis, providing 45 degrees of articulation. A suitable cable 56 and sheath may be obtained from Hayco Corp. of ShenZhen, CN under Model Number NPDSWARCBL.

Articulation of the trigger 28 may cause retraction of the cable 56 or forward advance of the cable 56, depending upon whether the cable 56 is connected to the trigger 28 on the retracting side or advance side of the pivot axis. Each actuation of the trigger 28 may rotate the periphery of the drive roll 50 three mm. The drive roll may be geared to the sheet 32 take-up roll 52 to cause peripheral rotation thereof. The take-up roll 52 may have a diameter of 6 mm before sheet 32 is wound therearound, and 9 mm when fully loaded with sheet 32 material therearound, at the end of the sheet 32 life.

Figure 7:
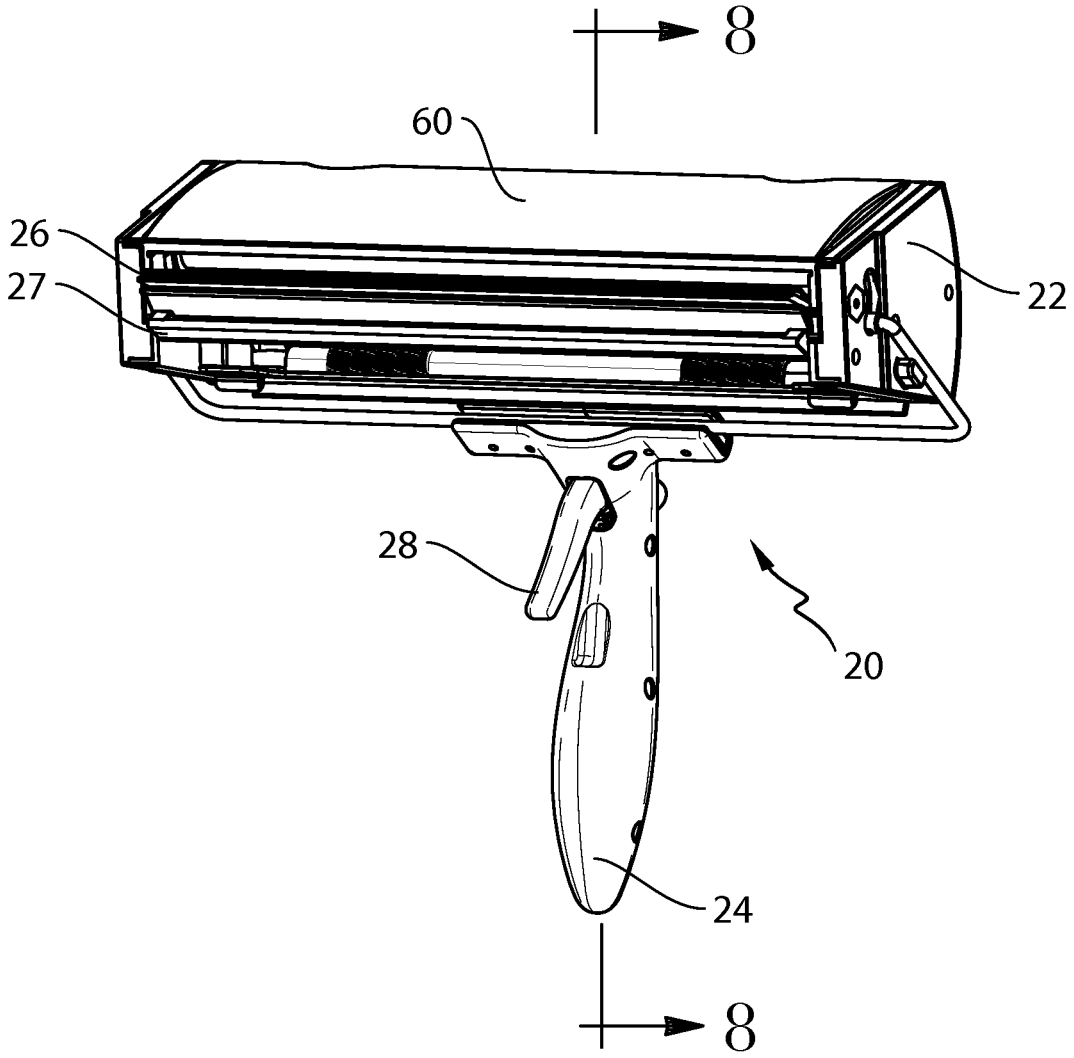
FIG. 7 is a frontal perspective view of the device of FIG. 6, having the cartridge installed into the head of the device.
Figure 8:
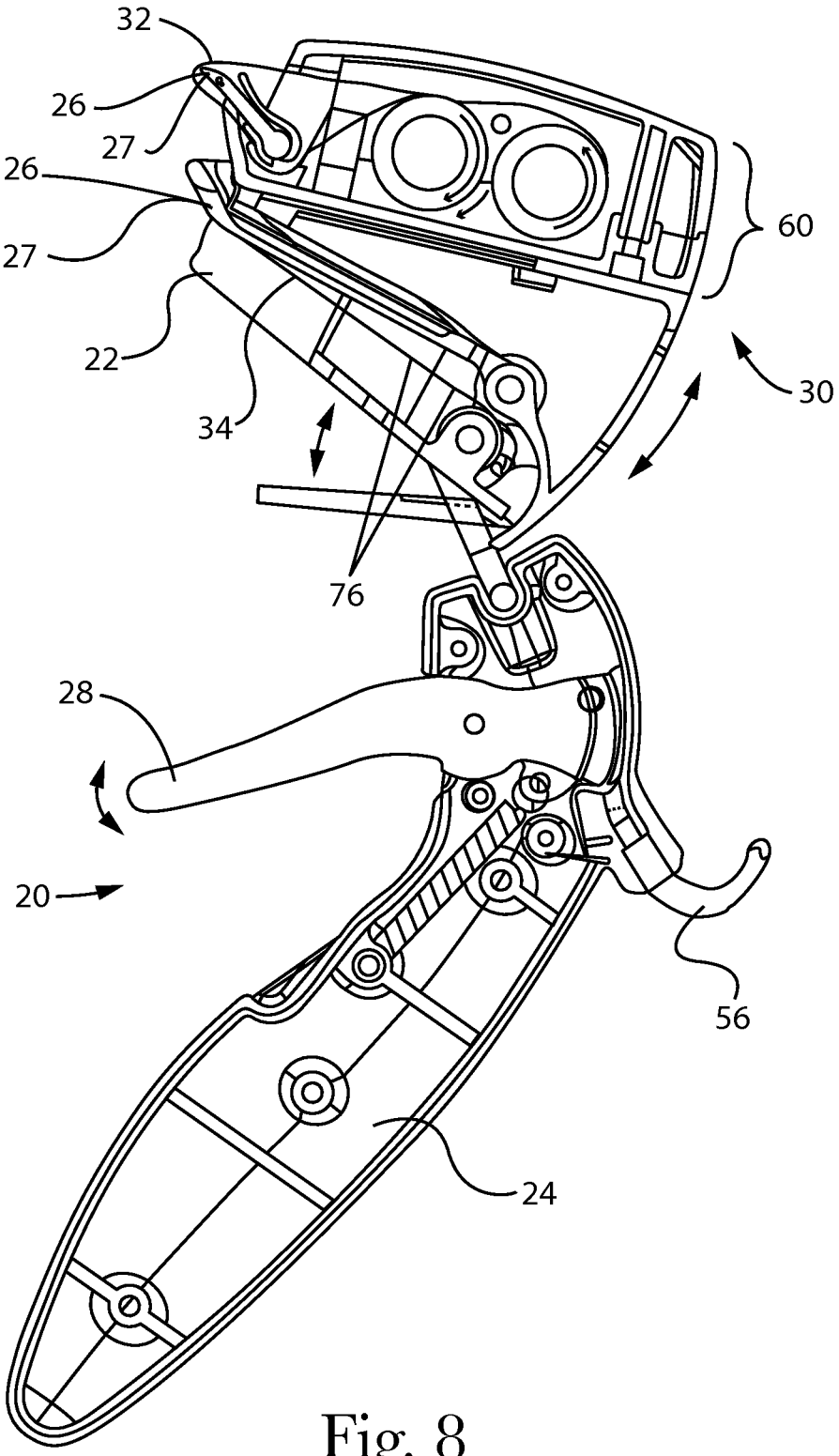
FIG. 8 is a vertical sectional view of the device of FIG. 7, taken along lines 8-8 of FIG. 7.
Figure 9:
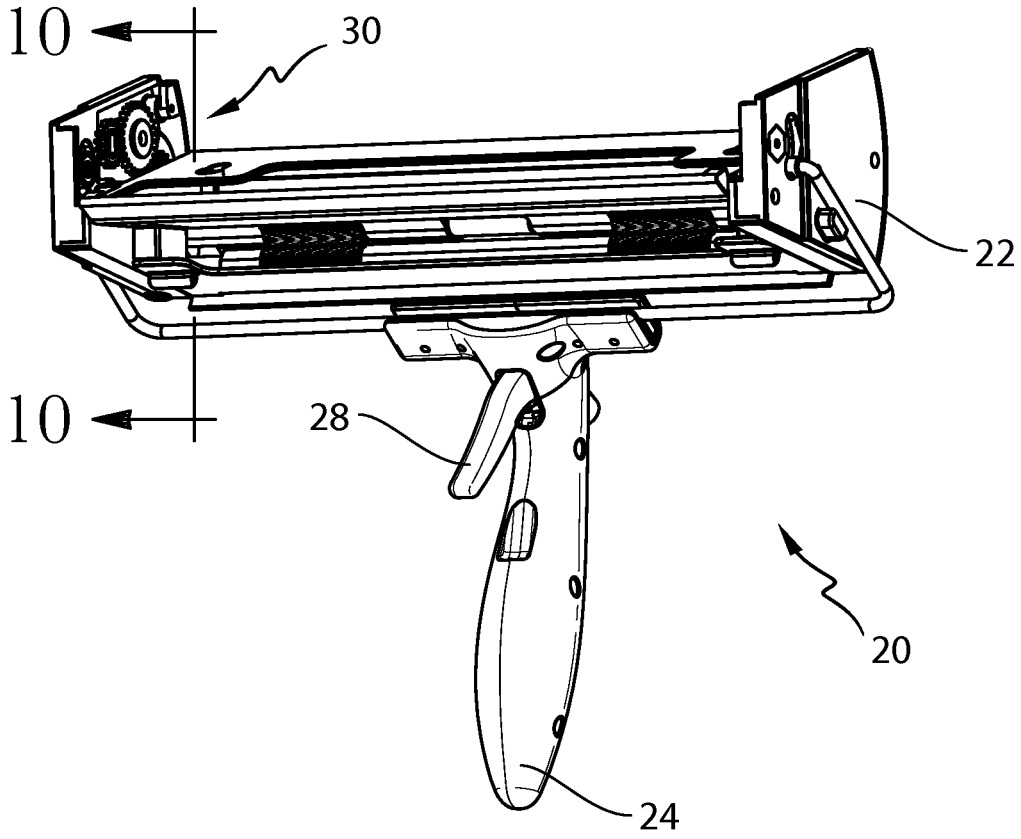
FIG. 9 is a frontal perspective view of the device of FIG. 7, having the cartridge removed.

Referring particularly to FIGS. 7 and 8, the device 20 may optionally further comprise an applicator for applying a liquid to the target surface. The liquid may wet, or otherwise treat, the target surface. The applicator for applying liquid to the target surface may include a prewetted substrate 34. Suitable liquids for application to the target surface include water, cleansers, surfactants, disinfectants, waxes, polishes, perfumes, paint, caulking, etc. and combinations thereof. Thus the device 20 may be used for applying liquid to, removing liquid from, mixing liquid(s)/solid(s) on, and/or spreading liquid(s)/solid(s) onto the target surface and combinations thereof.

This arrangement provides the benefit that the user may apply liquid to the target surface and renew the sheet 32 which cleans or otherwise treats the target surface, using a single device 20 having a single sheet advance mechanism 30 operably connected together by the device 20. This arrangement provides convenience, obviates the need for the user to manually wipe the trailing edge with a separate cloth or sheet 32 and allows for single-handed operation.

Referring again to FIGS. 6, 7, 8 9, and 10, the sheet 32 and the prewetted substrate 34 may be advanced using a common sheet advance mechanism 30. The sheet advance mechanism 30 may provide for equal or unequal longitudinal movement of the sheet 32 and the prewetted substrate 34. If unequal longitudinal movement is desired the sheet 32 may advance more than the prewetted substrate 34. A longitudinal advance ratio of 1:1 to 3:1, 4:1 or greater of sheet 32 to prewetted substrate 34 may be utilized.

The sheet 32 and prewetted substrate 34 may be driven by a common trigger 28. The trigger 28 may activate a cable 56 by pulling, as discussed above. The cable 56 may peripherally advance the drive roll 3 mm per trigger 28 actuation. The drive roll may be geared to the sheet 32 take-up roll 52 to provide a peripheral advance of 9 mm and geared to a prewetted substrate 34 take-up roll 52 to provide a peripheral advance of 3 mm.

Figure 10:
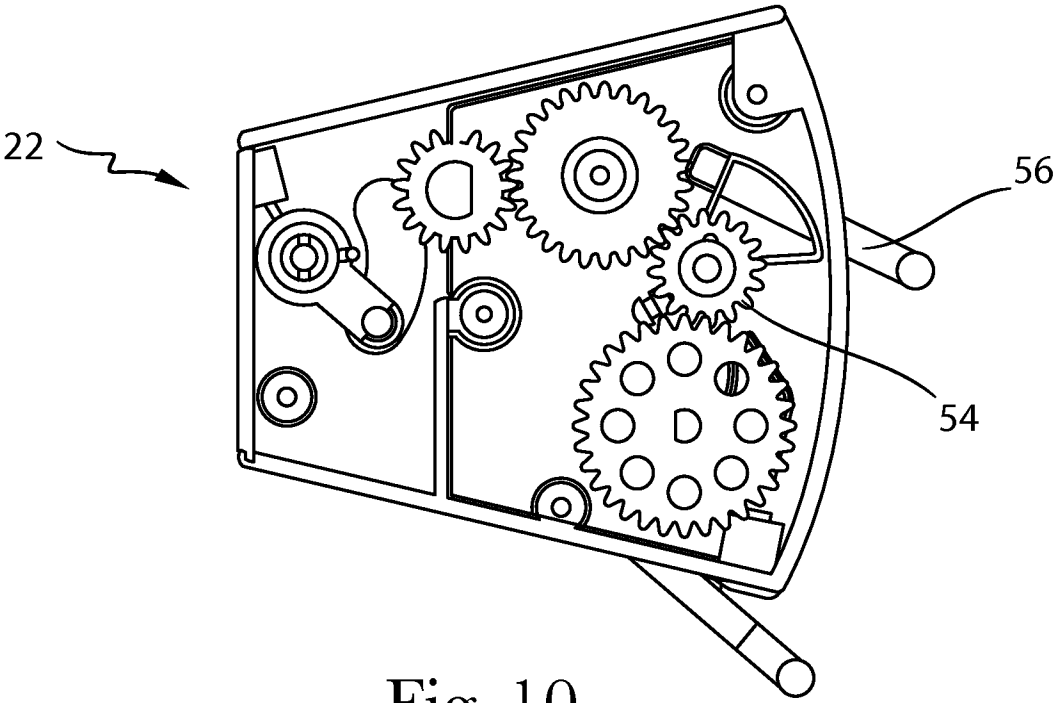
FIG. 10 is a profile view of the head of the device of FIG. 9, taken along lines 10-10 of FIG. 9.

Referring to FIGS. 8 and 10, the sheet 32 take-up roll 52 may rotate in the clockwise direction and the sheet 32 may move in the counterclockwise direction across the first pressure applying member 26. The prewetted substrate 34 take-up roll 52 may likewise rotate in the clockwise direction and the prewetted substrate 34 sheet 32 may move in the counterclockwise direction across the second pressure applying member 26. The sheet 32 take-up roll 52 and prewetted substrate 34 take-up roll 52 may rotate in the opposite directions relative to the drive gear 54.

The prewetted substrate 34 may be replaceably inserted into the head 22, and replaced as needed. The prewetted substrate 34 may be pressed against the target surface to express liquid therefrom.

The prewetted substrate 34 may comprise a nonwoven, foam absorbent material, or cellulosic sheet 32. The prewetted substrate 34 may be loaded with 0.5 to 12 grams of solution per gram of substrate and particularly about 3 grams of the liquid per gram of substrate. The absorbent ply may comprise a cellulosic material having a thickness of 0.5 to 12 millimeters, particularly about 2 millimeters, a basis weight of a basis weight of 30 to 500 grams per square meter, particularly about 200 grams per square meter and a density of 0.03 to 0.15, and particularly 0.4 to 0.09 grams per cubic centimeter. The prewetted substrate 34 can comprise an airlaid material, available from Buckeye Technologies, Inc, of Memphis, Tenn., a micro-fiber sheet 32 such as code EVO 80 available from Freudenberg Nonwovens, Weinheim, Germany or a laminate thereof. The laminae may be joined by heat sealing, adhesive bonding, ultrasonic bonding, etc.

In one embodiment a microfiber sheet 32 having a basis weight of 80 grams per square meter may be laminated to an absorbent airlaid core having a basis weight of 150 grams per square meter. These laminae may be further laminated to a third lamina comprising synthetic fibers, so that the airlaid core is disposed therebetween. The third lamina may have a basis weight of 15 to 50 grams per square meter. A suitable material for the third lamina may comprise a 20 grams per square meter spun-bond non-woven, of 50:50 PE/PET or 50:50 PE/PP bicomponent fibers available from Fiberweb plc of London, UK. The three laminae may be used for the prewetted substrate 34.

If desired, the prewetted substrate 34 may be provided with a leader 76. The leader 76 is a material which may or may not be prewetted, so that evaporation or contamination is not an issue. The leader 76 may comprise any liquid impervious film, such as a polymeric film, such as LDPE. The leader 76 may be joined in serial to the prewetted substrate 34. The leader may be relatively stiff, to facilitate loading into the device 20. The leader 76 may extend from the distal end of the second pressure applying member 26 to the respective draw roll(s) 38. The leader 76 provides the benefit that the prewetted substrate 34 may be fed onto a take-up roll 52 or nip rolls 38 without loss of the liquid to be applied to the target surface.

The leader 76 provides the benefit that the more expensive substrate need not be used to track through the sheet advance mechanism 30 to the prewetted substrate 34 take-up roll 52. This arrangement also provides the further benefit that liquid is not present on the leader 76, reducing total liquid load. The benefit of reducing total liquid load is reduced weight and expense.

The prewetted substrate 34 may be provided as a discrete sheet 32. The discrete sheet 32 may have a length of 30 mm to 100 cm, and particularly about 120 mm including a 45 mm dry leader 76 and 75 mm of wetted substrate. Each discrete sheet 32 may provide from 5 to 30 uses, and particularly about 20 uses.

One consideration in how many uses are to be provided by a particular pre-wetted sheet 32 include the period of time the prewetted sheet 32 will be contained within the head 22 or otherwise enclosed by the device 20. If the pre-wetted sheet 32 is contained too long, microbial contamination or evaporation of the liquid may result. Thus, a relatively longer prewetted substrate 34 may be used if a relatively shorter usage time is expected.

The prewetted substrate 34 may be pressed against the target surface through a second pressure applying member 26. The second pressure applying member 26 may extend from a proximal edge inside or juxtaposed with the housing, to a distal edge opposed thereto and suitable for pressing the prewetted substrate 34 against the target surface. The second pressure applying member 26 may have a first side and a second side opposed thereto, similar to the first pressure applying member 26.

The second pressure applying member 26 may be a stationary blade 27. The prewetted substrate 34 may move from the first side to the second side of the pressure applying member 26, as needed. The prewetted substrate 34 may be provided as a discrete sheet 32. The discrete sheet 32 may be loaded on a first side of the second pressure applying member 26 and travel past the distal end of thereof, to the second side of the second pressure applying member 26.

If desired, the trailing sheet 32 may be wider than the prewetted substrate 34. This geometry provides the benefit that outboard lines of liquid remaining on the on the target surface are reduced or eliminated.

Alternatively or additionally, the applicator for wetting or treating the target surface may include a spray bottle incorporated into the handle 24 or head 22. The spray bottle may be operated by a trigger 28 or push button, as is known in the art. The spray bottle may be refilled or replaced when the liquid therein is depleted.

Figure 11:
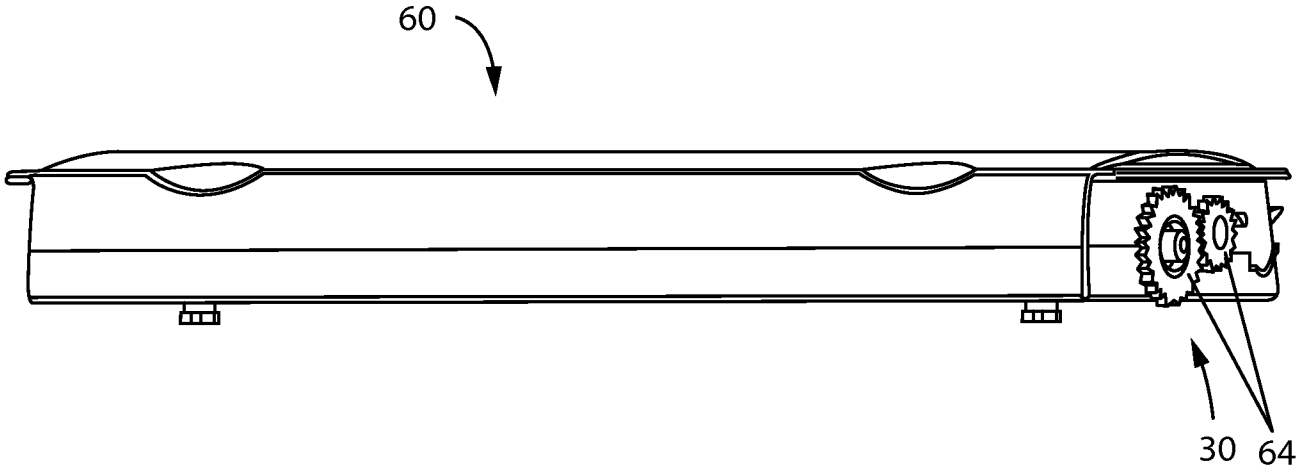
FIG. 11 is a perspective view of the cartridge of FIG. 6.
Figure 12:
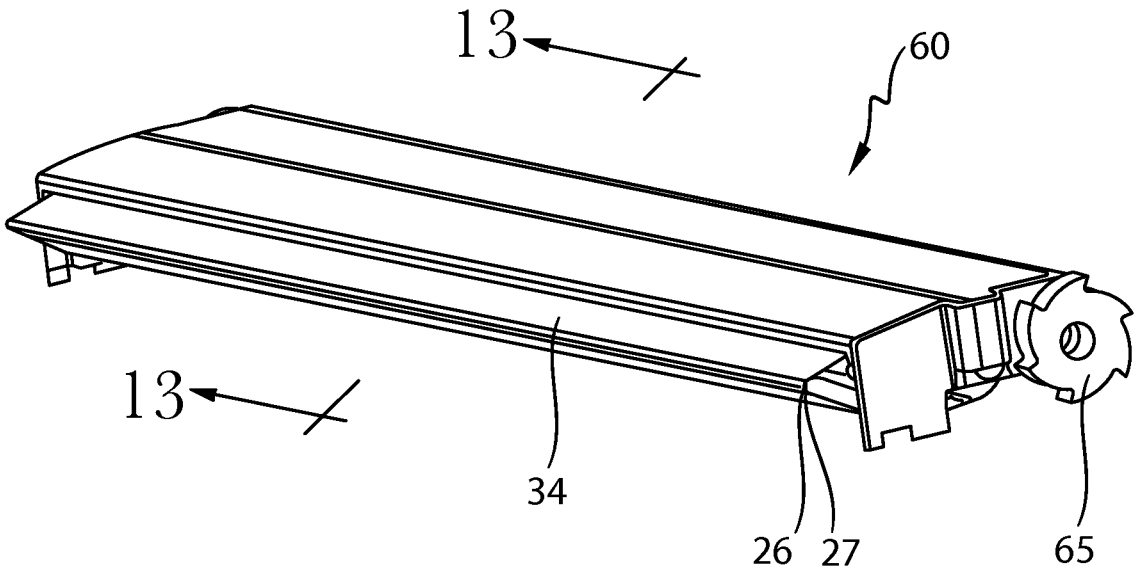
FIG. 12 is a perspective view of an alternative embodiment of the cartridge of FIG. 6.
Figure 13:
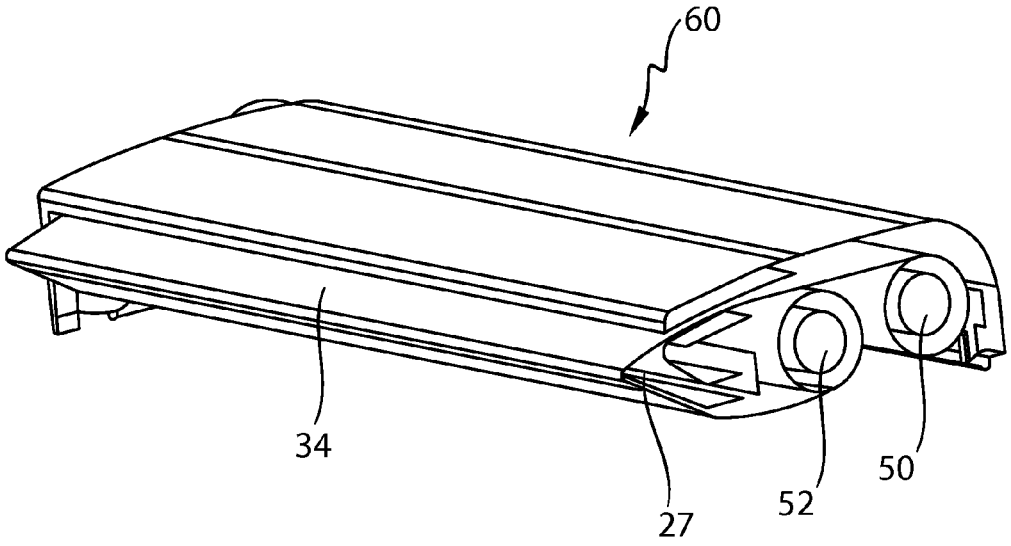
FIG. 13 is a perspective sectional view of the cartridge of FIG. 12, taken along lines 13-13 of FIG. 12.

Referring to FIGS. 11, 12 and 13, if desired the sheet 32, sheet 32 take-up roll 52, prewetted substrate 34 and/or prewetted substrate 34 take-up roll 52 may be provided as a single unit. The unit may be provided in the form of a cartridge 60. The cartridge 60 may be insertable into and removable from the head 22 as an integral assembly, as noted above. Each cartridge 60 may provide from 5 to 1000, or from 100 to 400 discrete uses and particularly 320 uses of the sheet 32. Each cartridge 60 may alternatively or additionally provide from 5 to 100 or 10 to 40 discrete uses and particularly 20 uses of the prewetted substrate 34.

The cartridge 60 may incorporate the sheet advance mechanism 30. The sheet advance mechanism of the cartridge 60 may incorporate on or more driven gears 64, as shown in FIG. 11. The driven gears may be advanced by articulation of the trigger 28.

Referring to FIG. 12, if desired the sheet advance mechanism 30 may incorporate a ratchet 65. The ratchet 65 may be driven by a pawl, as is known in the art. The pawl may, again, be driven by articulation of the trigger 28.

Referring generally to FIGS. 11, 12 and 13, this arrangement provides the benefit that the cartridge 60 may be sold separately from the handle 24/head 22 assembly and provided as a refill therefor. Different cartridges 60 may have different sheet 32 materials, different sheet 32 lengths, different prewetted substrate 34 materials, and/or different prewetted substrate 34 lengths, etc. as desired for a particular use.

Plural cartridges 60 may be sold in a single kit. The cartridges 60 may be identical or different, as intended for different end uses. Likewise different cartridges 60 may have different prewetted substrates 34, different prewetted substrate 34 lengths, etc. as desired for a particular use. A suitable prewetted substrate may comprise hydroxyl-terminated polydimethylsiloxane. The polysiloxane may have functional groups which bind to the hydroxyl group of glass surface. Such chemistry makes the liquid a cleaner a cleaner suitable for use on a glass target surface.

If desired, the cartridge 60 may further include the first pressure applying member 26 and or the second pressure applying member 26. This arrangement provides the benefit that the sheet 32 may be pre-wound through the path from the respective supply to the respective take-up roll 52. Alternatively or additionally, the prewetted substrate 34 may be pre-wound through the path from the respective supply to the respective take-up roll 52. This arrangement provides further benefit that different cartridges 60 may have different first and/or second pressure applying members 26, each tailored to a particular use.

The first pressure applying member 26 may comprise a blade 27. The blade 27 may be made of nitrile rubber, as is known in the art, urethane for improved abrasion resistance, or other compliant, resilient materials. A Shore A Durometer hardness ranging from 70 to 90, a width of 10 to 100, or 15 to 25 centimeters, and a thickness of 1 to 3 millimeters may be suitable for removing liquid cleaner applied to a glass target surface for the purpose of cleaning the glass. Particularly, a blade 27 made of nitrile rubber, having a Shore A Durometer hardness of 80, a width of 15 centimeters, a thickness of 2 millimeters has been found suitable. Such a blade 27 may be purchased from Ettore Cleaning of Wixom, Mich. or Unger Global of Bridgeport, Conn.

As the compressive force applied through the handle 24 by the user, to the blade 27, against the target surface increases, the complaint material of the blade 27 may spread somewhat increasing the contact area of the blade 27 against the target surface area. By increasing the contact area commensurate with increasing the applied force, approximately constant pressure can be maintained and severe pressure spikes avoided.

In an alternative embodiment, the blade 27 may be made of high carbon spring steel. The spring steel is resilient, allowing flexing against the target surface as the applied compressive force becomes too great. Such a blade 27 may range in thickness from 0.05 to 0.5 millimeters and not be tapered at the distal edge. This arrangement allows the blade 27 to treat the liquid, particularly a more viscous liquid, applied to the target surface with less applied force, and still achieve pressure comparable to that achieved using a thicker rubber blade 27, as discussed above.

Alternatively, the blade 27 may be made of silicone material and have a lip configuration at the tip such as that described U.S. Pat. No. 6,243,911. This design can prophetically conform well to curved surfaces, such as car windshields, and to textured surfaces such as shower doors.

Alternatively, the blade 27 may be made of polyvinyl chloride and be shaped as disclosed in U.S. D461,2875 or U.S. D429,0465 and sold by Cleret Inc of Portland Oreg. A double blade 27 design may be utilized, providing yet another trailing edge behind the advanceable sheet 32.

Optionally, the blade 27 may be disposed in a replaceable cartridge 60. This arrangement allows for periodic replacement of the blade 27, as the cartridge 60 is replaced. Alternatively, the blade 27 may be directly mounted to the head 22.

The blade 27 may be pressed against the target surface to treat a liquid thereon. For example, the blade 27 may be used as a squeegee to remove liquid from the target surface or may be used as a float to evenly distribute liquid on a target surface. The pressure of compressive force applied by the blade 27 treats the liquid in a manner that would not otherwise occur.

A cleaning solution may be used in conjunction with the device 20 of the present invention. A typical cleaning solution may be sprayed onto a window or other target surface, or the cleaning solution may be applied by the device 20 itself.

Many common cleaning solutions have a surface energy of 30 dynes per centimeter, or less to promote spreading, and attempt to minimize streaking. With water, having a surface tension of 73 dynes per centimeter, beading on a glass target surface is more likely to occur.

If desired, the device 20 of the present invention may be used with a cleaning solution having a surface tension of more than 30 dynes per centimeter relative to the surface being cleaned or otherwise treated. A cleaning solution having a surface tension greater than 30 dynes per centimeter may be achieved by adding agents such as quaternary ammonium compounds, polysiloxanes, cationic polymers, etc. to the cleaning solution.

If desired, the surface tension of the cleanser used with the device 20 of the present invention may be correlated with the surface energy of the blade 27. A common nitrile rubber blade 27 has a surface energy of 29 dynes per centimeter. Such a 29 dynes per centimeter surface energy is relatively close to the 30 dynes per centimeter surface tension of a typical cleaning solution. The inventors have unexpectedly found that a rubber blade having a 29 dynes per centimeter surface energy may clean more effectively using water (higher surface tension) than common cleaning solutions (lower surface tension). Thus, a cleaning solution having a surface tension greater than 35, 40, 45 or 50 dynes per centimeter may be used with the present invention.

Alternatively or additionally, the blade 27, or pressure applying member 26, may be modified to have a particular surface energy. For example the blade 27, or sheet 32 used with the pressure applying member 26 may be treated with or comprise silicone or polytetrafluorethylene to reduce the surface energy thereof. Reducing the surface energy of the blade 26 or sheet 32 used with the pressure applying member 27 relative to the cleaning solution increases beading of the cleaning solution, thereby making the solution easier to remove from the target surface. Thus the blade 26, pressure applying member 27 and/or sheet 32 may have a surface energy 5, 10, 15 or 20 dynes per centimeter less than the surface tension of the cleaning solution.

Alternatively or additionally, the blade 27, or pressure applying member 26, may be modified to have a particular surface energy. For example the blade 27, or sheet 32 used with the pressure applying member 26 may be treated with or comprise materials to increase the surface energy thereof. Increasing the surface energy of the blade 26 or sheet 32 used with the pressure applying member 27 relative to the cleaning solution increases spreading of the solution, thereby making the solution easier to leave a film on the target surface.

If desired, the cleaning solution may further comprise an agglomerating polymer to agglomerate particles, making the particles easier to remove during the cleaning process. Suitable agglomerating polymers include polyacrylamide such as MIRAPOL® SURF-S available from Rhodia of France, HYPERFLOC® available from HyChem Inc. of Tampa, Fla. and polyethyleneimines such as LUPASOL® available from BASF of Germany. Such agents may be incorporated into the prewetted substrate 34. A separate cleaning solution having a greater surface tension may be also or alternatively be used.

If desired, the squeegee blade 27 may comprise an agent which modifies the surface energy of the squeegee. For example, the squeegee blade 27 and/or the sheet 32 may be treated with silicon or polytetrafluoroethylene to reduce the surface energy thereof. If a PE film is selected for the sheet 32, the surface energy may be reduced to 5-10 dynes per centimeter. Reducing the surface energy of the blade 27 increases beading of the liquid thereon, making the liquid easier to remove from the target surface. Alternatively, the squeegee blade 27 may be treated to increase the surface energy. Increasing the surface energy of the squeegee blade 27 causes the solution to bead up from the target surface, and be more easily removed. One of skill will recognize that the surface energy may be selectively increased or decreased by selection of the particular sheet 32 used with the device of the present invention.

Exemplary materials usable for the first or second pressure applying member 26 are shown in Table I below. The properties in Table I are graded from 1-5, with 5 reflecting excellent performance for the parameter listed in that column, 1 reflecting poor performance for the parameter listed in that column, and 2-4 reflecting relative intermediate performance.

TABLE I

| PROPERTY | Natural-rubber/ Isoprene NR/IR | Styren-butadien rubber SBR | Butadiene rubber BR | Ethylene-propylene rubber EPM/EPDM | Butyl rubber IIR | Chloroprene rubber CR | Nitrile rubber NBR | Silicone Rubber PMQ |
|---|---|---|---|---|---|---|---|---|
| Tear strength | 4 | 3 | 3 | 3 | 3 | 3 | 3 | 1 |
| Abrasion resistance | 4-5 | 4-5 | 5 | 3 | 3 | 3-4 | 3 | 1-2 |
| Water swelling | 4 | 4 | 4 | 5 | 4 | 2-3 | 3-4 | 2 |
| Rebound low temp. | 5 | 3 | 5 | 3 | 1 | 3 | 3 | 5 |
| Rebound high temp. | 5 | 3 | 5 | 3 | 3 | 4 | 3 | 5 |

A roller may be usable for the pressure applying member 26. The roller may have a Shore A Durometer hardness ranging from 40 to 90, a width of 5 to 60 cm, and a diameter of 1 to 12 millimeters. Particularly, a roller made of nitrile rubber, having a Shore A Durometer hardness of 70, a width of 25 centimeters, and diameter of 3 millimeters has been found suitable for the pressure applying member 26.

Figure 14:
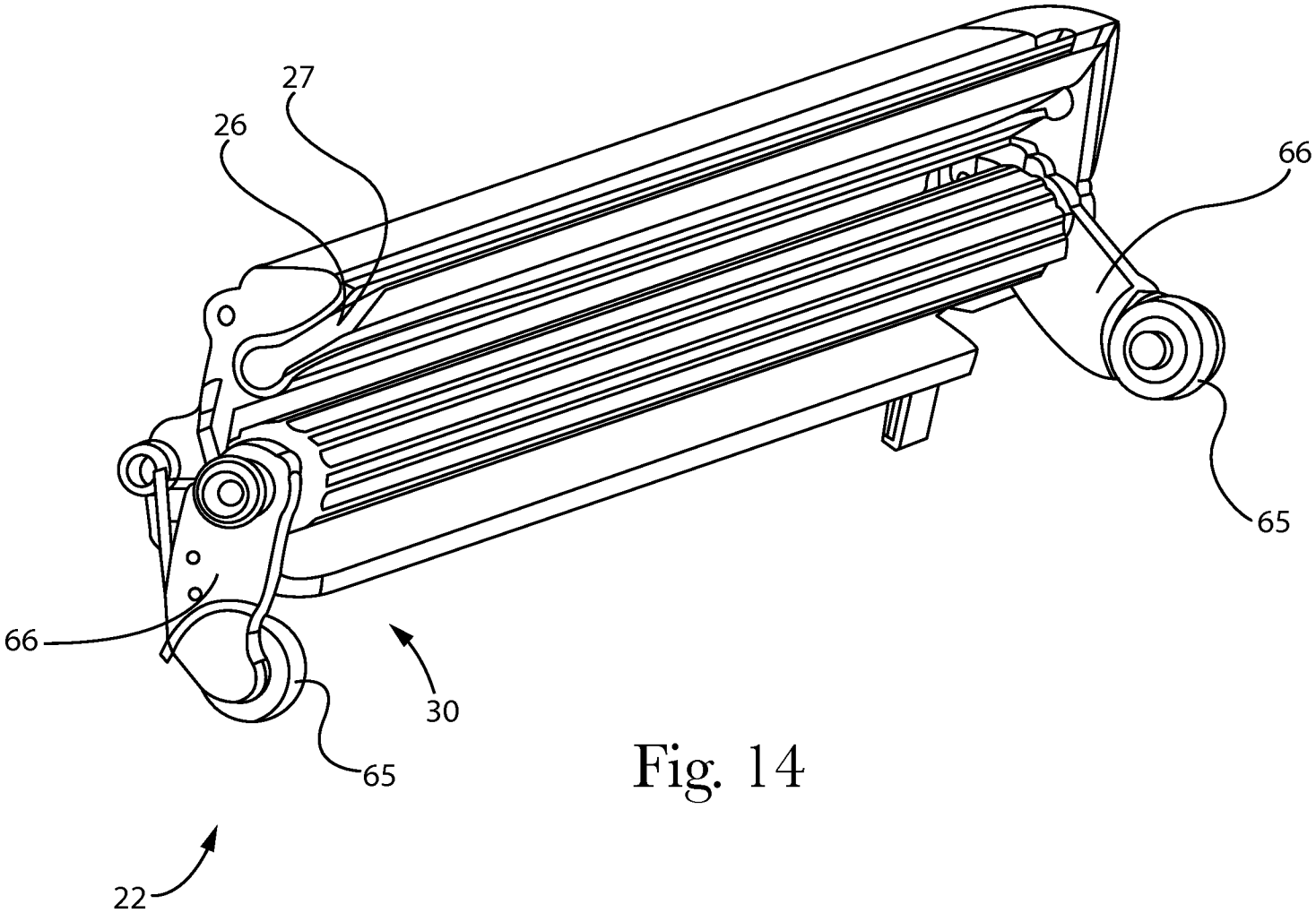
FIG. 14 is a bottom perspective view of an alternative embodiment device further comprising sleds for providing stability against the target surface and optionally usable as an indexing mechanism.
Figure 15:
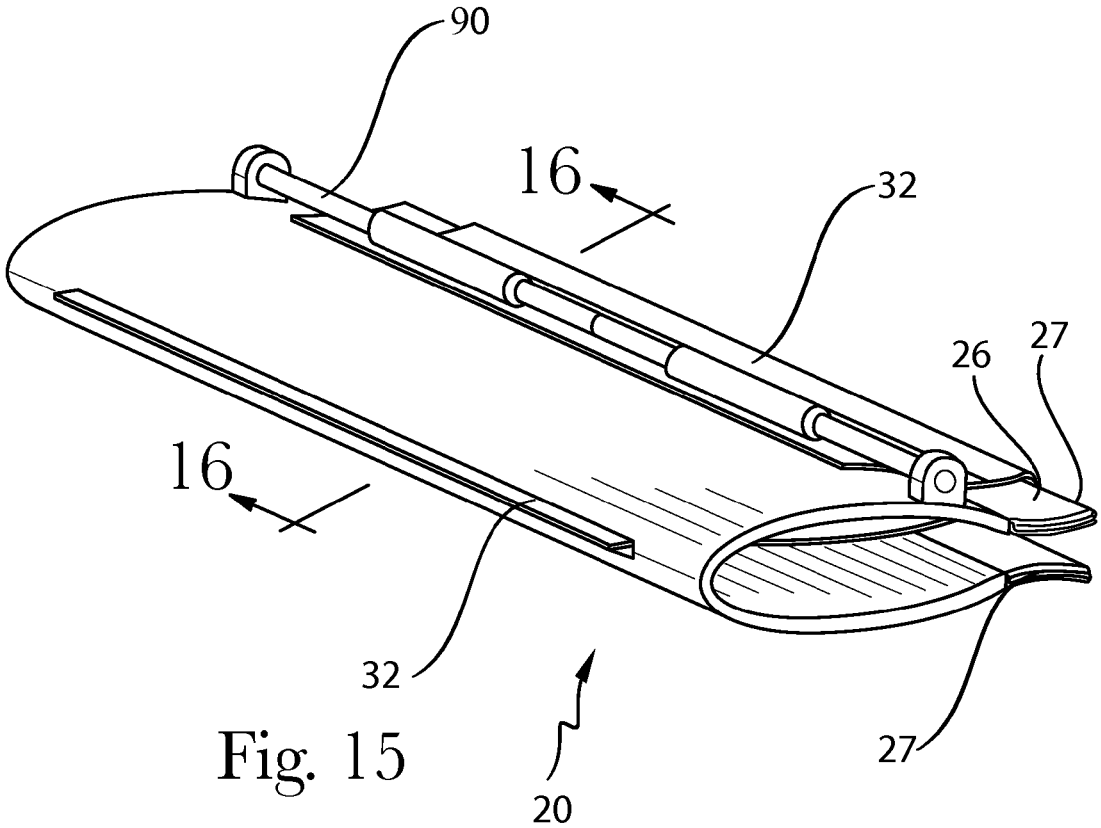
FIG. 15 is a rear perspective view of an alternative embodiment device having a preloaded sheet disposed intermediate two pressure applying members usable as a squeegee and capable of bilateral motion.
Figure 16:
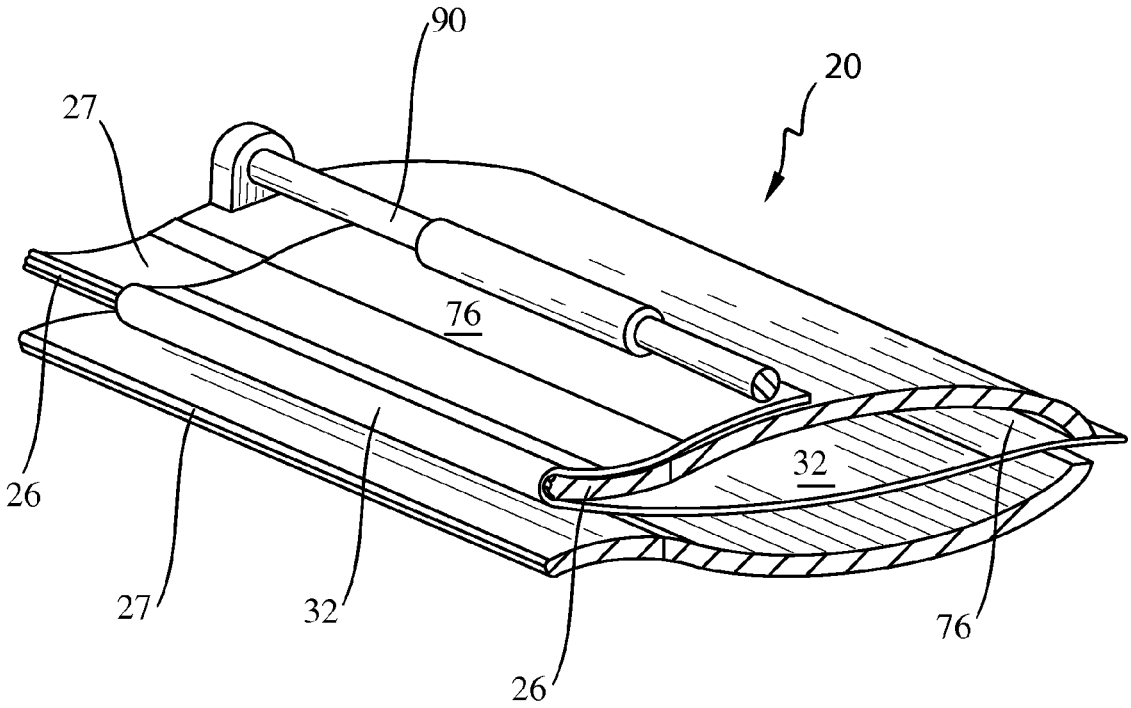
FIG. 16 is a frontal perspective sectional view of the device of FIG. 14, taken along lines 16-16 of FIG. 15.

Referring to FIG. 14, if desired, the device 20 may further comprise one or more sleds 65. The sleds 65 improve the stability of the device 20 as it is moved along the target surface The sleds 65 may slide along the target surface, may comprise tracking wheels which roll across the target surface or any other suitable configuration which aids in moving the device 20 in a desired manner.

Each tracking wheel may be mounted on an arm 66. The arm 66 may extend from a proximal end juxtaposed with, or in a degenerate case coincident one of the rolls, such as the drive roll. The distal end of the arm 66 may have an axle, providing for axial rotation of the tracking wheel.

The arm 66 may be articulable about an axis juxtaposed with the proximal end. The arm 66 may be spring biased, to provide more consistent force against the target surface.

If desired, one of the arms 66 may be connected to the index portion of the sheet advance mechanism 30. In such an embodiment retraction of the arm 66 after the device 20 is released from the target surface causes the film to advance and longitudinally index over the blade 27. Thus, in such an embodiment, the arm 66 acts as an index mechanism, similar to trigger 28.

Referring to FIGS. 15, 16, 17 and 18, if desired, the pressure applying member 26 used for expressing liquid from the prewetted sheet 32 may be disposed intermediate two or more pressure applying members 26 usable to squeegee liquid from, or to spread liquid across, the target surface. This arrangement provides for generally bilateral motion on the target surface. During such bilateral motion, the prewetted sheet 32 may act as the leading edge with respect to the pressure applying member 26 following, which acts as a trailing edge.

If desired, this device 20 may incorporate a rotatable tucker bar 90. The rotatable tucker bar 90 may be oriented parallel to the widthwise direction and provide the dual functionality of holding the sheet 32 taut and assist in longitudinal advance of the sheet 32. The user may simply pull the end of the sheet in the longitudinal direction to advance the sheet 32, as desired.

Figure 17:
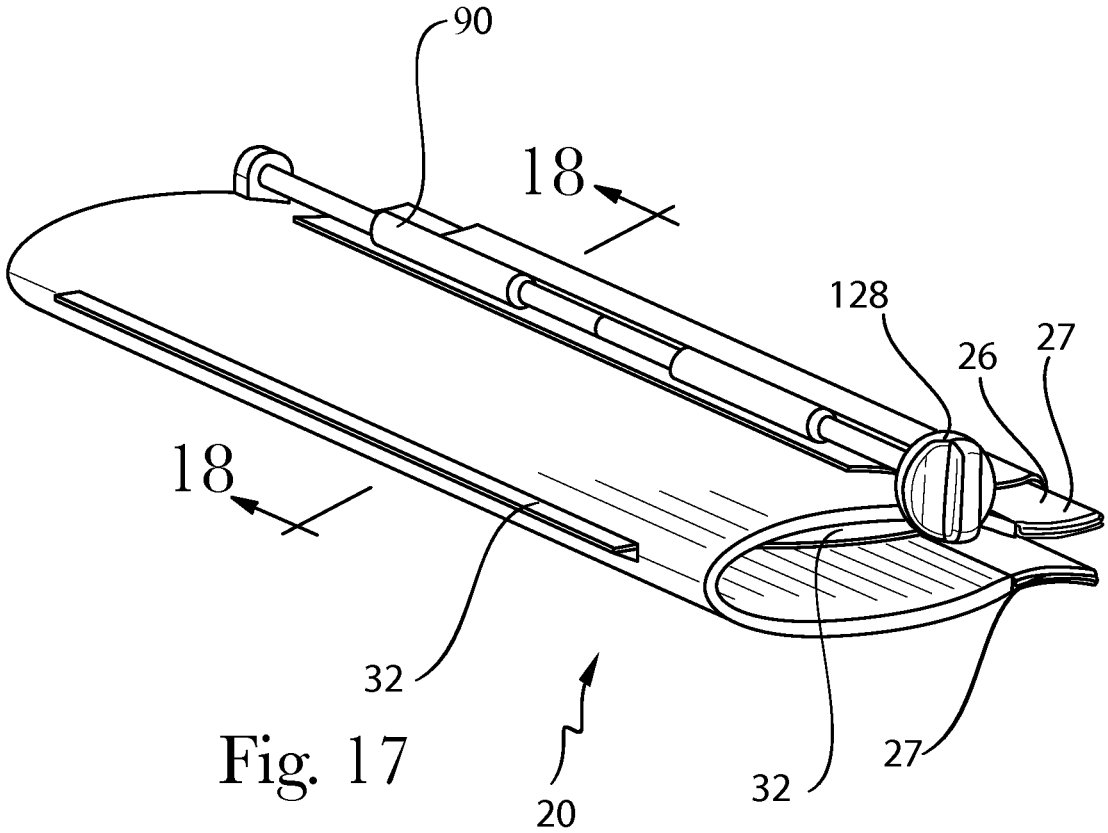
FIG. 17 is a rear perspective view of an alternative embodiment of the squeegee device of FIG. 15 having an optional rotatable knob to advance the sheet.
Figure 18:
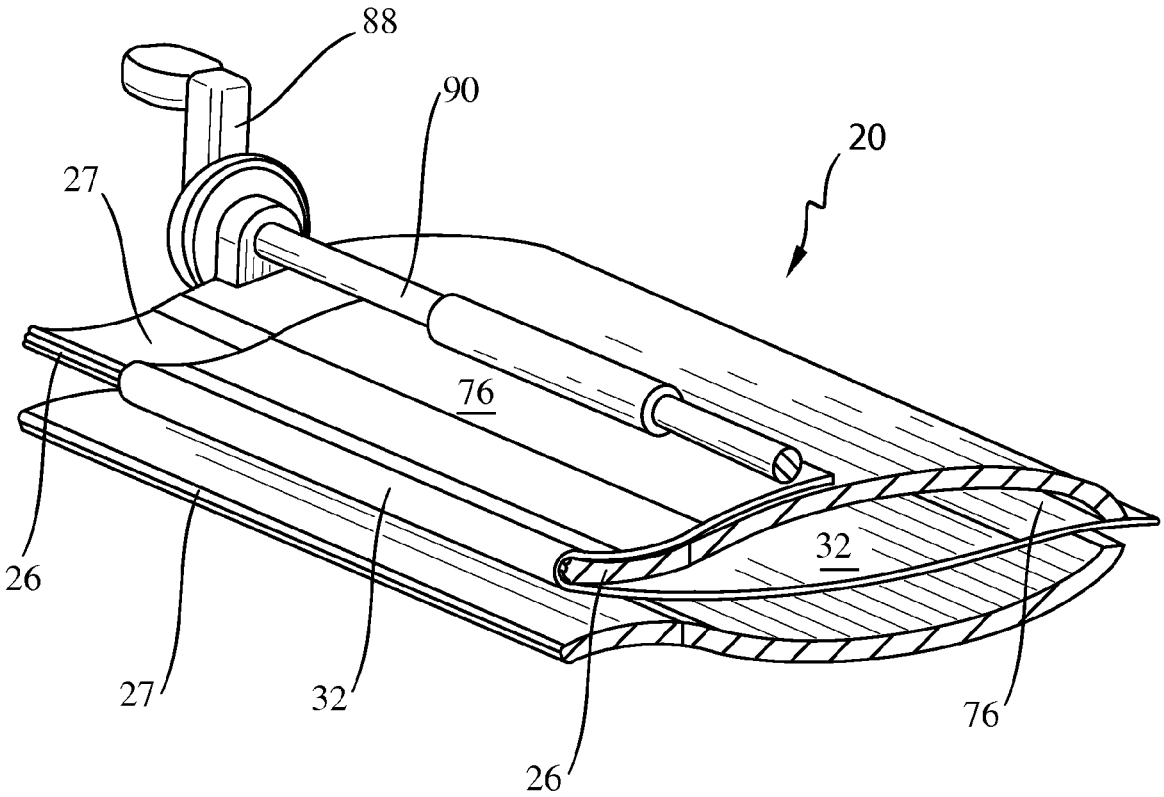
FIG. 18 is a frontal perspective sectional view of the device of FIG. 17, taken along lines 18-18 of FIG. 17 and substituting an optional rotatable crank for the optional rotatable knob.

Referring to FIG. 17, if desired, the tucker bar 90 may be rotated by the user. This rotation may be assisted by a knob 138. The knob 138 may be rotated by the user, as desired. Alternatively or additionally, Referring to FIG. 18, the tucker bar tucker bar 90 may be rotated by using a crank 88.

The device 20 of FIGS. 15-18 is shown to have two parallel blades 26 of equal width and thickness and a single tucker bar 90. But the invention is not so limited. If desired, the device 20 may have two tucker bars 90, one associated with each blade 26. Additionally or alternatively, the device 20 may have three or more blades 26. Each of the two, three or more blades 26 may be of identical or different construction.

If desired, one or both of the blades 26 may have a relatively low surface energy, to improve beading and collection of liquid from a window or other target surface. One or both of the blades 26 may comprise material selected from the group consisting of rubber, polyurethane and combinations thereof. Alternatively, one or both of the blades 26 may be coated with a material selected from the group consisting of silicones, fluoropolymers and combinations thereof. This material and/or coating may provide a surface energy of less than 10 dynes per cm and particularly between 5 and 10 dynes per cm.

Figure 19:
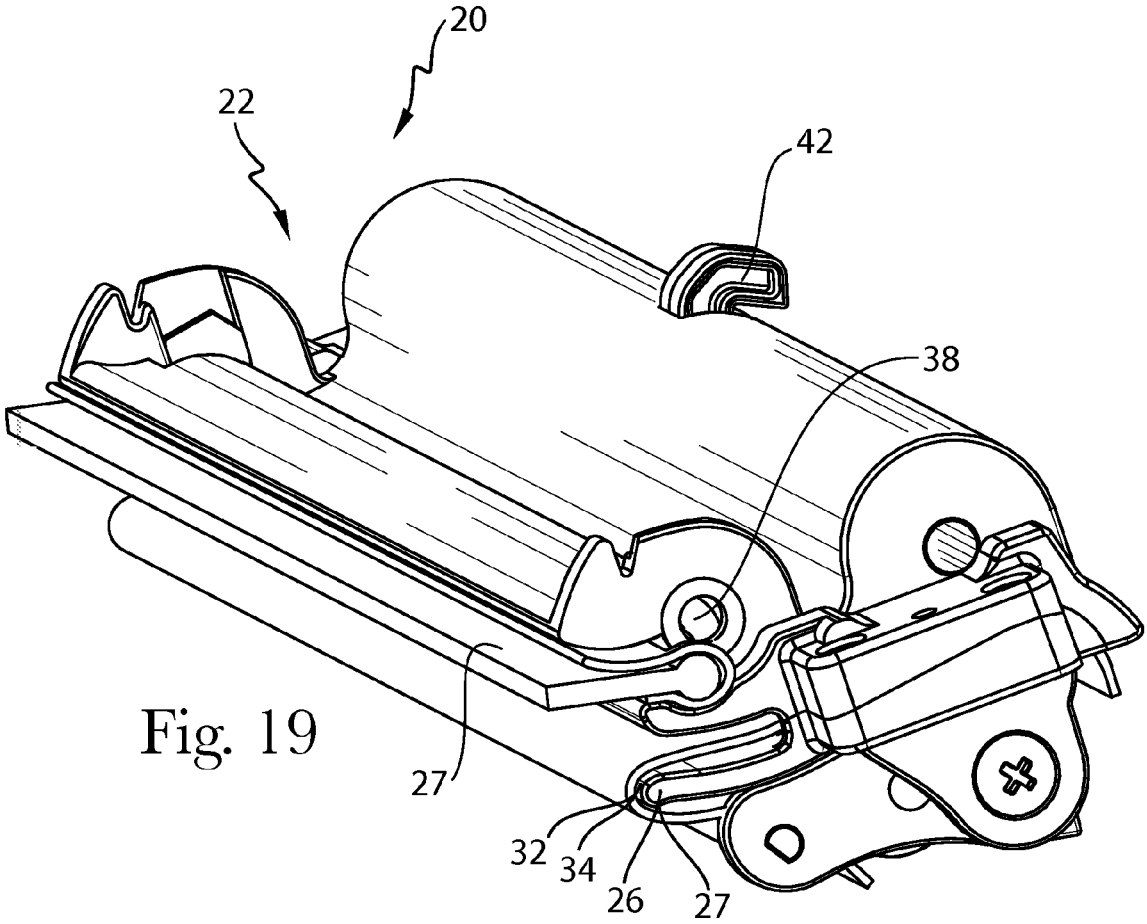
FIG. 19 is a frontal perspective view of an alternative embodiment device, similar to that of FIGS. 3-5, and having no handle or trigger thereon.

Referring to FIG. 19, if desired the device 20 may comprise a head 22 which is gripped by the user. The head 22 may not have a handle 24 or a trigger 28. Instead, the user directly grips the head 22 to clean a window or to otherwise treat a target surface.

When the user wishes to advance the sheet 32, 34, the user may simply press the pawl 42. The pawl 42 provides the same longitudinal sheet 32, 34 advance function described above relative to the embodiments of FIGS. 3-5. A similar index mechanism may be used. The embodiment of FIGS. 3-5 provides the benefit of single-handed operation. The embodiment of FIG. 19 provides the benefits of lighter weight and being able to reach into tighter spaces than a device 20 having a handle.

Figure 20:
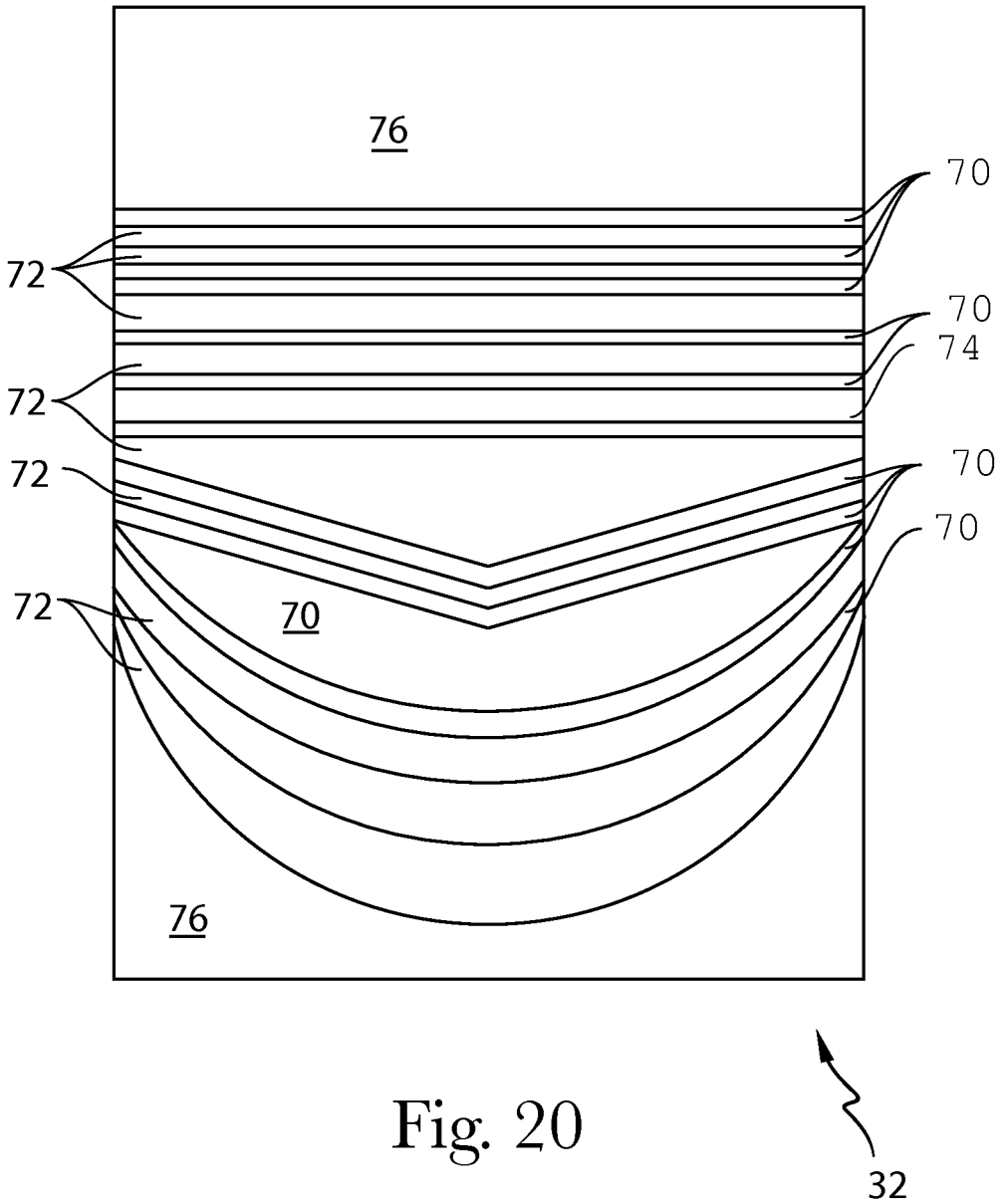
FIG. 20 is a top plan view of a sheet usable with any of the devices of the present invention and having alternating zones of preloaded substrate and dry sheet material. The sheet further has a leader.

Referring to FIG. 20, if desired, a single sheet 32 may serve as both the prewetted substrate 34 for applying liquid to the target and as the sheet 32 for treating liquid applied thereto. The single sheet 32 may have alternating spaced apart first zones 70 and second zones 72. The first and second zones 72 may extend predominately in the width wise direction and may be disposed perpendicular to the longitudinal axis.

The first zones 70 may comprise the prewetted substrate 34 material as described above. The first zones 70 may be absorbent, and impregnated with any desired solution. The second zones 72 may comprise a polyolefinic film, as described above for the sheet 32. Suitable chemistries for the first zone 70 comprise materials for cleaning, waxing, or otherwise treating the target surface.

This arrangement provides the benefit that a single device 20 may be used to first apply a liquid to the target surface. Upon longitudinal advance of the single sheet 32, the second zones 72 may be utilized to treat the target surface and/or remove liquid therefrom.

While the alternating zones are shown to be of equal and constant width, straight, and perpendicular to the longitudinal axis, the invention is not so limited. If desired, the alternating zones may be curvilinear. Alternatively, either the first zone 70 or the second zones 72 may be wider than the other.

While zones 70, 72 having a major dimension in the predominantly widthwise dimension are shown, the invention is not so limited. The zones 70, 72 may be disposed in the longitudinal direction or at a diagonal relative thereto.

If desired, the sheet 32 may comprise three zones 70, 72, and 74. The first zone 70 to contact the target surface may comprise scrubbing material and may comprise microfiber, cellulose, polyester, nylon, melamine and combinations thereof and be usable for scrubbing the target surface. The second zone 72 may provide wetting to the target surface and may comprise prewetted substrate material as described above. The third zones 76 may provide a drying function. The third zone 76 may comprise absorbent material, such as cellulose, sponge, etc or simply be a polyolefinic sheet.

In another execution the first zone 70 may be used for sanding or abrading a target surface. The second zone 72 may be used for collecting dust and debris generated during the sanding operation. The first zone 70 may comprise encapsulated pockets of epoxy resin/hardener which are mixed upon rupture against the target surface. Upon hardening, the first zones 70 have sufficient abrasion properties. The second zones 74 may comprise a flat or textured nonwoven for collecting the dust. In such an arrangement the first pressure applying member 26 may be toothed to rupture the pouches of resin and hardener. The second pressure applying member 26 may then be irregular to mix the resin and hardener as the pressure applying member 26 passes through the mixture.

The single sheet 32, having the alternating first and second zones 72, may be provided as a refill kit for use with the device 20. A plurality of such sheets 32 may be sold in a single refill kit. Of course, the sheets 32 may be mutually identical or may be different. For example, a first sheet 32 may have a solution specifically usable for cleaning a window, a second sheet 32 specifically usable for cleaning a countertop and a third sheet 32 specifically usable for cleaning a floor may be disposed in a single kit.

Devices 20, sheets 32 and prewetted substrates 34 according to the present invention may be used for cleaning windows, dusting floors, applying surface treatments, smoothing concrete, sanding, etc.

In another execution, the sheet 32 may be used to apply a consistent thin film of a specific solution or coating chemistry to a substrate. For example in the printing industry, applying a thin, consistent layer of ink to a surface is often desirable. If the blade 27 or other pressure applying member 26 is not cleaned at some frequency, the thickness of the ink may vary. The renewable surface can move over a blade 27 or pressure applying edge to provide for a consistent coating thickness.

Another execution of applying a consistent, thin film to a substrate occurs when one wishes apply a consistent, thin coating of varnish, stain oil, or polish or lacquer to hardwood floor or other wood surface. Yet another execution may occur when applying a temporary or semi-permanent shine enhancing polymer, such as a water repellant coating or wax to any vertical or horizontal surface. Another execution may occur when applying water to an ice surface using a Zamboni machine or applying water over concrete to provide uniformity.

Generally, the device 20 and method of the present invention may be used in any application where a permanent squeegee edge is used. Additionally, applications not previously typically associated with squeegees may be utilized as well. For example, one could use the device 20 of the present invention to apply paint to a target surface, adhesive to a backing surface, protectant to a carpet, etc.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A squeegee in combination with a prewetted sheet and having a pair of spaced apart blades extending in a widthwise direction, each of said blades extending from a proximal end to a distal end, said proximal ends of said blades being joined to a head, said head having an inner surface and an outer surface opposed thereto, said head having a tucker bar joined thereto, said tucker bar being axially rotatable to longitudinally advance the prewetted sheet between said tucker bar and said outer surface of said head, wherein each blade of said pair of blades comprises identical material selected from the group consisting of rubber, polyurethane and combinations thereof, or wherein at least one of said squeegee blades is coated with a material selected from the group consisting of silicones, fluoropolymers and combinations thereof.

2. A squeegee according to claim 1 wherein said axially rotatable tucker bar is parallel to the widthwise direction.

3. A squeegee according to claim 2 wherein said tucker bar further comprises a knob or crank for use by a user to cause manual rotation of said tucker bar and thereby advance a sheet between said tucker bar and the outer surface of said head.

4. A squeegee according to claim 3 wherein said prewetted sheet comprises a liquid having a surface tension greater than 35 dynes per centimeter.

5. A squeegee according to claim 4 wherein at least one said blade has a surface energy less than 25 dynes per centimeter.

6. A squeegee according to claim 5 wherein said blades outwardly diverge.

7. A method of cleaning a window, said method comprising the step of wiping said window with the sheet disposed in the squeegee according to claim 1.

8. A squeegee having a pair of spaced apart blades extending in a widthwise direction and defining a space therebetween, each of said blades extending from a proximal end to a distal end, said proximal ends of said blades being joined to a head, said head having an inner surface and an outer surface opposed thereto, said head having a tucker bar joined thereto, said tucker bar being manually axially rotatable to longitudinally advance a sheet between said tucker bar and said outer surface of said head, said head having a slot therethrough, said slot being disposed on said head intermediate said pair of spaced apart blades to allow a sheet to longitudinally advance from the outside of said head to the inside of said head or vice versa for accumulation of said sheet within said space.

9. A squeegee according to claim 8 wherein each end of said tucker bar is mounted on a trunnion, each end of said trunnion being juxtaposed with an edge of said head.

10. A squeegee according to claim 8 wherein said slot is substantially parallel to said widthwise direction.

11. A squeegee having a pair of spaced apart blades extending in a widthwise direction, each of said blades extending from a proximal end to a distal end, said proximal ends of said blades being joined to a head, said head having an inner surface and an outer surface opposed thereto, said head having a tucker bar joined thereto, a supply of longitudinally extending sheet, said supply of sheet being disposed on the outside of said head, between said tucker bar and said outer surface of said head, across the distal end of one said blade and inside of said head for accumulation of said sheet inside of said head and intermediate said spaced apart blades.

12. A squeegee according to claim 11 wherein said sheet is prewetted and further comprises at least one agglomerating polymer.

13. A squeegee according to claim 12 wherein said tucker bar is axially rotatable.

14. A squeegee according to claim 13 wherein said tucker bar is axially rotatable to advance said sheet in a longitudinal direction from the outside of said head across the distal end of one said blade to the inside of said head.

15. A squeegee according to claim 13 wherein said tucker bar is axially rotatable to advance said sheet in a longitudinal direction from the inside of said head, across the distal end of one said blade to the outside of said head.

16. A squeegee according to claim 11 wherein said sheet comprises alternating zones of prewetted material and absorbent material.

17. A squeegee according to claim 16 wherein said prewetted material comprises liquid having a liquid surface tension, at least one of said squeegee blades comprises material having a surface energy ranging from 5 to 10 dynes per cm less than said liquid surface tension.

18. A squeegee according to claim 11, wherein each blade of said pair of blades comprises identical material selected from the group consisting of rubber, polyurethane and combinations thereof.

19. A squeegee according to claim 11 wherein at least one of said squeegee blades is coated with a material selected from the group consisting of silicones, fluoropolymers and combinations thereof.

20. A squeegee according to claim 19, wherein each blade of said pair of blades is identically coated with material selected from the group consisting silicones, fluoropolymers and combinations thereof.

* * * * *